US011725879B2

(12) United States Patent
Mak et al.

(10) Patent No.: US 11,725,879 B2
(45) Date of Patent: Aug. 15, 2023

(54) METHODS AND CONFIGURATION FOR RETROFITTING NGL PLANT FOR HIGH ETHANE RECOVERY

(71) Applicant: Fluor Technologies Corporation, Sugar Land, TX (US)

(72) Inventors: John Mak, Santa Ana, CA (US); Sabrina Devone, Richmond, TX (US); James Shih, Houston, TX (US); Curt Graham, Mission Viejo, CA (US)

(73) Assignee: Fluor Technologies Corporation, Irving, TX (US)

( * ) Notice: Subject to any disclaimer, the term of this patent is extended or adjusted under 35 U.S.C. 154(b) by 996 days.

(21) Appl. No.: 16/325,696

(22) PCT Filed: Sep. 8, 2017

(86) PCT No.: PCT/US2017/050636
§ 371 (c)(1),
(2) Date: Feb. 14, 2019

(87) PCT Pub. No.: WO2018/049128
PCT Pub. Date: Mar. 15, 2018

(65) Prior Publication Data

US 2020/0141639 A1 May 7, 2020

Related U.S. Application Data

(60) Provisional application No. 62/489,234, filed on Apr. 24, 2017, provisional application No. 62/385,748, filed on Sep. 9, 2016.

(51) Int. Cl.

| | |
|---|---|
| ***F25J 3/02*** | (2006.01) |
| ***C10G 5/04*** | (2006.01) |
| ***C10G 5/06*** | (2006.01) |

(52) U.S. Cl.
CPC ..... *F25J 3/0238* (2013.01); *C10G 5/04* (2013.01); *C10G 5/06* (2013.01); *F25J 3/0209* (2013.01);
(Continued)

(58) Field of Classification Search
CPC ..... F25J 3/0209; F25J 3/0238; F25J 3/0233; F25J 2205/60; F25J 2200/70
See application file for complete search history.

(56) References Cited

U.S. PATENT DOCUMENTS 2,603,310 A 7/1952 Gilmore et al.
2,771,149 A 11/1956 Miller et al.
(Continued)

FOREIGN PATENT DOCUMENTS

AR 103703 5/2017
AR 115412 A1 1/2021
(Continued)

OTHER PUBLICATIONS

Notice of Allowance dated Aug. 20, 2021, Canadian Patent Application No. 3008229 filed Jan. 15, 2016.
(Continued)

*Primary Examiner* — Brian M King
(74) *Attorney, Agent, or Firm* — Conley Rose, P.C.

(57) ABSTRACT

A natural gas liquid plant is retrofitted with a bolt-on unit that includes an absorber that is coupled to an existing demethanizer by refrigeration produced at least in part by compression and expansion of the residue gas, wherein ethane recovery can be increased to at least 99% and propane recovery is at least 99%, and where a lower ethane recovery of 96% is required, the bolt-on unit does not require the absorber, which could be optimum solution for
(Continued)

revamping an existing facility. Contemplated configurations are especially advantageous to be used as bolt-on upgrades to existing plants.

8 Claims, 7 Drawing Sheets

(52) U.S. Cl.
CPC .... *F25J 3/0233* (2013.01); *C10G 2300/1025* (2013.01); *C10G 2300/4056* (2013.01); *F25J 2200/02* (2013.01); *F25J 2200/30* (2013.01); *F25J 2200/76* (2013.01); *F25J 2205/04* (2013.01); *F25J 2205/60* (2013.01); *F25J 2215/62* (2013.01); *F25J 2290/80* (2013.01)

(56) References Cited

U.S. PATENT DOCUMENTS 3,320,754 A 5/1967 Tucker et al.
3,421,610 A 1/1969 Marshall et al.
3,421,984 A 1/1969 Jensen et al.
3,793,157 A 2/1974 Hobbs et al.
4,004,430 A 1/1977 Solomon et al.
4,061,481 A 12/1977 Campbell et al.
4,102,659 A 7/1978 Martin
4,157,904 A 6/1979 Campbell et al.
4,164,452 A 8/1979 Funk et al.
4,203,742 A 5/1980 Agnihotri
4,278,457 A 7/1981 Campbell et al.
4,453,958 A 6/1984 Gulsby et al.
4,474,591 A 10/1984 Arand et al.
4,496,380 A 1/1985 Harryman
4,507,133 A 3/1985 Khan et al.
4,509,967 A 4/1985 Sweet
4,519,824 A 5/1985 Huebel
4,617,039 A 10/1986 Buck
4,657,571 A 4/1987 Gazzi
4,676,812 A 6/1987 Kummann
4,695,349 A 9/1987 Becker et al.
4,854,955 A 8/1989 Campbell et al.
4,895,584 A 1/1990 Buck et al.
5,220,797 A 6/1993 Krishnamurthy et al.
5,291,736 A 3/1994 Paradowski
5,462,583 A 10/1995 Wood et al.
5,555,748 A 9/1996 Campbell et al.
5,657,643 A 8/1997 Price
5,669,238 A 9/1997 Devers
5,685,170 A 11/1997 Sorensen
5,687,584 A 11/1997 Mehra
5,746,066 A 5/1998 Manley
5,771,712 A 6/1998 Campbell et al.
5,881,569 A * 3/1999 Campbell ..... F25J 3/0209 62/621
5,890,377 A 4/1999 Foglietta
5,890,378 A 4/1999 Rambo et al.
5,953,935 A 9/1999 Sorensen
5,983,664 A 11/1999 Campbell et al.
5,992,175 A 11/1999 Yao et al.
6,006,546 A 12/1999 Espie
6,112,549 A 9/2000 Yao et al.
6,116,050 A 9/2000 Yao et al.
6,116,051 A 9/2000 Agrawal et al.
6,125,653 A 10/2000 Shu et al.
6,182,469 B1 2/2001 Campbell et al.
6,244,070 B1 6/2001 Lee et al.
6,308,532 B1 10/2001 Hopewell
6,311,516 B1 11/2001 Key et al.
6,336,344 B1 1/2002 OBrien
6,354,105 B1 * 3/2002 Lee ..... F25J 3/0209 62/619
6,363,744 B2 4/2002 Finn et al.
6,368,385 B1 4/2002 Paradowski
6,401,486 B1 6/2002 Lee et al.
6,405,561 B1 6/2002 Mortko et al.
6,453,698 B2 9/2002 Jain et al.
6,516,631 B1 2/2003 Trebble
6,601,406 B1 8/2003 Deng et al.
6,658,893 B1 12/2003 Mealey
6,712,880 B2 3/2004 Foglietta et al.
6,755,965 B2 6/2004 Pironti et al.
6,823,692 B1 11/2004 Patel et al.
6,837,070 B2 1/2005 Mak
6,915,662 B2 7/2005 Wilkinson et al.
2,051,552 A1 5/2006 Mak
2,051,553 A1 5/2006 Mak et al.
2,069,744 A1 7/2006 Patel et al.
7,073,350 B2 7/2006 Mak
7,107,788 B2 9/2006 Patel et al.
7,159,417 B2 1/2007 Foglietta et al.
7,192,468 B2 3/2007 Mak et al.
7,216,507 B2 5/2007 Cuellar et al.
7,219,513 B1 5/2007 Mostafa
7,377,127 B2 5/2008 Mak
7,424,808 B2 9/2008 Mak
7,437,891 B2 10/2008 Reyneke et al.
7,574,856 B2 8/2009 Mak
7,597,746 B2 10/2009 Mak et al.
7,600,396 B2 10/2009 Mak
7,635,408 B2 12/2009 Mak et al.
7,637,987 B2 12/2009 Mak
7,674,444 B2 3/2010 Mak
7,713,497 B2 5/2010 Mak
7,856,847 B2 12/2010 Patel et al.
7,856,848 B2 12/2010 Lu
8,110,023 B2 2/2012 Mak et al.
8,117,852 B2 2/2012 Mak
8,142,648 B2 3/2012 Mak
8,147,787 B2 4/2012 Mak et al.
8,192,588 B2 6/2012 Mak
8,196,413 B2 6/2012 Mak
8,209,996 B2 7/2012 Mak
8,316,665 B2 11/2012 Mak
8,377,403 B2 2/2013 Mak
8,398,748 B2 3/2013 Mak
8,434,325 B2 5/2013 Martinez et al.
8,480,982 B2 7/2013 Mak et al.
8,505,312 B2 8/2013 Mak et al.
8,528,361 B2 9/2013 Nanda et al.
8,567,213 B2 10/2013 Mak
8,635,885 B2 1/2014 Mak
8,661,820 B2 3/2014 Mak
8,677,780 B2 3/2014 Mak
8,695,376 B2 4/2014 Mak
8,696,798 B2 4/2014 Mak
8,840,707 B2 9/2014 Mak
8,845,788 B2 9/2014 Mak
8,850,849 B2 10/2014 Martinez et al.
8,876,951 B2 11/2014 Mak
8,893,515 B2 11/2014 Mak
8,910,495 B2 12/2014 Mak
8,919,148 B2 12/2014 Wilkinson et al.
8,950,196 B2 2/2015 Mak
9,103,585 B2 8/2015 Mak
9,114,351 B2 8/2015 Mak
9,132,379 B2 9/2015 Mak
9,248,398 B2 2/2016 Mak
9,423,175 B2 8/2016 Mak
9,557,103 B2 1/2017 Mak
9,631,864 B2 4/2017 Chen et al.
10,006,701 B2 6/2018 Mak
10,077,938 B2 9/2018 Mak
10,330,382 B2 6/2019 Mak et al.
10,451,344 B2 10/2019 Mak
10,704,832 B2 7/2020 Mak
10,760,851 B2 9/2020 Thiebault et al.
11,112,175 B2 9/2021 Mak
11,365,933 B2 6/2022 Mak et al.
2002/0042550 A1 4/2002 Pironti et al.
2002/0157538 A1 10/2002 Foglietta et al.
2003/0005722 A1 1/2003 Wilkinson et al.
2003/0089126 A1 5/2003 Stringer et al.
2004/0079107 A1 4/2004 Wilkinson et al.

(56) References Cited

U.S. PATENT DOCUMENTS

| | | | | |
|---|---|---|---|---|
| 2004/0148964 | A1 | 8/2004 | Patel et al. | |
| 2004/0159122 | A1 | 8/2004 | Patel et al. | |
| 2004/0172967 | A1 | 9/2004 | Patel et al. | |
| 2004/0206112 | A1 | 10/2004 | Mak | |
| 2004/0237580 | A1 | 12/2004 | Mak | |
| 2004/0250569 | A1 | 12/2004 | Mak | |
| 2004/0261452 | A1 | 12/2004 | Mak et al. | |
| 2005/0047995 | A1 | 3/2005 | Wylie | |
| 2005/0218041 | A1 | 10/2005 | Yoshida et al. | |
| 2005/0247078 | A1 | 11/2005 | Wilkinson et al. | |
| 2005/0255012 | A1 | 11/2005 | Mak | |
| 2005/0268649 | A1 | 12/2005 | Wilkinson et al. | |
| 2006/0000234 | A1 | 1/2006 | Cuellar et al. | |
| 2006/0021379 | A1 | 2/2006 | Ronczy | |
| 2006/0032269 | A1 | 2/2006 | Cuellar et al. | |
| 2006/0260355 | A1 | 11/2006 | Roberts et al. | |
| 2006/0277943 | A1 | 12/2006 | Yokohata et al. | |
| 2006/0283207 | A1 | 12/2006 | Pitman et al. | |
| 2007/0157663 | A1 | 7/2007 | Mak et al. | |
| 2007/0240450 | A1 | 10/2007 | Mak | |
| 2008/0016909 | A1 | 1/2008 | Lu | |
| 2008/0271480 | A1 | 11/2008 | Mak | |
| 2009/0100862 | A1 | 4/2009 | Wilkinson et al. | |
| 2009/0113931 | A1 | 5/2009 | Patel et al. | |
| 2009/0277217 | A1 | 11/2009 | Ransbarger et al. | |
| 2010/0000255 | A1 | 1/2010 | Mak | |
| 2010/0011809 | A1 | 1/2010 | Mak | |
| 2010/0011810 | A1 | 1/2010 | Mak et al. | |
| 2010/0043488 | A1 | 2/2010 | Mak et al. | |
| 2010/0126187 | A1 | 5/2010 | Mak | |
| 2010/0206003 | A1 | 8/2010 | Mak | |
| 2010/0275647 | A1 | 11/2010 | Johnke et al. | |
| 2010/0287984 | A1 | 11/2010 | Johnke et al. | |
| 2011/0067442 | A1 | 3/2011 | Martinez et al. | |
| 2011/0067443 | A1* | 3/2011 | Martinez | F25J 3/0233 62/620 |
| 2011/0174017 | A1 | 7/2011 | Victory et al. | |
| 2011/0226014 | A1* | 9/2011 | Johnke | F25J 3/0209 62/620 |
| 2011/0265511 | A1 | 11/2011 | Fischer et al. | |
| 2012/0000245 | A1 | 1/2012 | Currence et al. | |
| 2012/0085127 | A1 | 4/2012 | Nanda et al. | |
| 2012/0096896 | A1 | 4/2012 | Patel et al. | |
| 2012/0137726 | A1 | 6/2012 | Currence et al. | |
| 2013/0061632 | A1 | 3/2013 | Brostow et al. | |
| 2013/0061633 | A1 | 3/2013 | Mak et al. | |
| 2013/0186133 | A1 | 7/2013 | Ploeger et al. | |
| 2013/0298602 | A1 | 11/2013 | Prim | |
| 2014/0013797 | A1 | 1/2014 | Butts | |
| 2014/0026615 | A1 | 1/2014 | Mak | |
| 2014/0060114 | A1 | 3/2014 | Mak | |
| 2014/0075987 | A1 | 3/2014 | Mak | |
| 2014/0182331 | A1 | 7/2014 | Burmberger et al. | |
| 2014/0260420 | A1 | 9/2014 | Mak | |
| 2014/0290307 | A1* | 10/2014 | Gahier | F25J 3/0238 62/620 |
| 2014/0345319 | A1* | 11/2014 | Corte Real Santos | F25J 3/0209 62/618 |
| 2015/0184931 | A1 | 7/2015 | Mak | |
| 2015/0322350 | A1 | 11/2015 | Iyer et al. | |
| 2016/0069610 | A1 | 3/2016 | Ascencion et al. | |
| 2016/0231052 | A1 | 8/2016 | Mak | |
| 2016/0327336 | A1 | 11/2016 | Kennedy et al. | |
| 2017/0051970 | A1 | 2/2017 | Mak | |
| 2017/0058708 | A1 | 3/2017 | Noureldin et al. | |
| 2017/0336137 | A1 | 11/2017 | Mak et al. | |
| 2018/0017319 | A1 | 1/2018 | Mak et al. | |
| 2018/0058754 | A1 | 3/2018 | Lynch et al. | |
| 2018/0066889 | A1 | 3/2018 | Gasking et al. | |
| 2018/0149425 | A1 | 5/2018 | Oneal et al. | |
| 2018/0231305 | A1 | 8/2018 | Pierre, Jr. | |
| 2018/0266760 | A1 | 9/2018 | Mak | |
| 2018/0306498 | A1 | 10/2018 | Rovers et al. | |
| 2018/0320960 | A1 | 11/2018 | Terrien et al. | |
| 2018/0347899 | A1 | 12/2018 | Cuellar et al. | |
| 2019/0011180 | A1 | 1/2019 | Mostafa | |
| 2019/0086147 | A1 | 3/2019 | Brown, III et al. | |
| 2019/0120550 | A1 | 4/2019 | Mak | |
| 2019/0154333 | A1 | 5/2019 | Mak | |
| 2019/0242645 | A1 | 8/2019 | Mak | |
| 2019/0271503 | A1 | 9/2019 | Terrien et al. | |
| 2020/0064064 | A1 | 2/2020 | Butts | |
| 2020/0072546 | A1 | 3/2020 | Thom et al. | |
| 2020/0141639 | A1 | 5/2020 | Mak | |
| 2020/0191477 | A1 | 6/2020 | Mak | |
| 2020/0199046 | A1 | 8/2020 | Simon et al. | |
| 2020/0370824 | A1 | 11/2020 | Mak et al. | |
| 2021/0095921 | A1 | 4/2021 | Mak et al. | |
| 2021/0381760 | A1 | 12/2021 | Mak | |

FOREIGN PATENT DOCUMENTS

| | | | |
|---|---|---|---|
| AU | 2002303849 | A1 | 12/2003 |
| AU | 2008287322 | A1 | 2/2009 |
| AU | 2011349713 | A1 | 7/2013 |
| CA | 2176430 | A1 | 4/1997 |
| CA | 2484085 | A1 | 12/2003 |
| CA | 2694149 | A1 | 2/2009 |
| CA | 3084911 | A1 | 12/2012 |
| CA | 2976071 | | 8/2017 |
| CA | 289132 | C | 9/2020 |
| CA | 2976071 | C | 10/2020 |
| CA | 3008229 | C | 1/2022 |
| CN | 101815915 | A | 8/2010 |
| CN | 113795461 | A | 12/2021 |
| DE | 60224585 | T2 | 4/2009 |
| EA | 201390957 | A1 | 12/2013 |
| EP | 0010939 | A1 | 5/1980 |
| EP | 1508010 | A1 | 2/2005 |
| EP | 2185878 | A1 | 5/2010 |
| EP | 2521761 | A1 | 11/2012 |
| EP | 2655992 | A1 | 10/2013 |
| EP | 3256550 | A1 | 12/2017 |
| EP | 3400278 | A1 | 11/2018 |
| EP | 3894047 | A1 | 10/2021 |
| GC | 0004114 | | 4/2016 |
| JP | 2007510124 | A | 4/2007 |
| MX | 2010001472 | A | 3/2010 |
| MX | 2013007136 | A | 8/2013 |
| MX | 391995 | | 5/2022 |
| NO | 20044580 | A | 12/2004 |
| WO | 99023428 | A1 | 5/1999 |
| WO | 0188447 | A1 | 11/2001 |
| WO | 2002014763 | | 2/2002 |
| WO | 2002079706 | | 10/2002 |
| WO | 2003095913 | | 11/2003 |
| WO | 2003100334 | | 12/2003 |
| WO | 2004017002 | A1 | 2/2004 |
| WO | 2004065868 | A2 | 8/2004 |
| WO | 2004076946 | A2 | 9/2004 |
| WO | 2004080936 | A1 | 9/2004 |
| WO | 2005045338 | A1 | 5/2005 |
| WO | 2007001669 | A2 | 1/2007 |
| WO | 2007014069 | A2 | 2/2007 |
| WO | 2007014209 | A2 | 2/2007 |
| WO | 2008002592 | A2 | 1/2008 |
| WO | 2009023252 | A1 | 2/2009 |
| WO | 20111232478 | A1 | 10/2011 |
| WO | 2012087740 | A1 | 6/2012 |
| WO | 2012177749 | A2 | 12/2012 |
| WO | 2014047464 | A1 | 3/2014 |
| WO | 2014151908 | A1 | 9/2014 |
| WO | 2016130574 | A1 | 8/2016 |
| WO | 2017119913 | A1 | 7/2017 |
| WO | 2017200557 | A1 | 11/2017 |
| WO | 2018049128 | A1 | 3/2018 |
| WO | 2019078892 | A1 | 4/2019 |

(56) References Cited

FOREIGN PATENT DOCUMENTS

| | | | |
|---|---|---|---|
| WO | 2019226156 | A1 | 11/2019 |
| WO | 20200123814 | A1 | 6/2020 |

OTHER PUBLICATIONS

Office Action dated Jul. 29, 2021, Canadian Patent Application No. 3084911 filed Jun. 20, 2012.
Office Action dated Nov. 5, 2021, filed Jan. 29, 2019, U.S. Appl. No. 16/260,288.
Office Action dated Nov. 4, 2021, U.S. Appl. No. 16/390,687, filed Apr. 22, 2019.
Office Action dated Sep. 9, 2021, Mexican Patent Application No. MX/a/2016/009162 filed Jul. 13, 2016.
Advisory Action dated Nov. 16, 2021, U.S. Appl. No. 16/219,126, filed Dec. 13, 2018.
Office Action dated Dec. 29, 2021, Saudi Arabian Patent Application No. 51891931, filed Jan. 15, 2016.
Office Action dated Dec. 13, 2021, Australian Patent Application filed May 18, 2016.
Office Action dated Dec. 21, 2021, Brazilian Patent Application filed Sep. 8, 2017.
Notice of Allowance dated Feb. 24, 2022, U.S. Appl. No. 16/390,687, filed Apr. 22, 2019.
Notice of Allowance dated Mar. 7, 2022, Mexican Patent Application No. MX/a/2016/009162 filed Jul. 13, 2016.
Office Action dated Mar. 11, 2022, U.S. Appl. No. 16/421,138, filed May 23, 2019.
Final Office Action dated Apr. 20, 2022, U.S. Appl. No. 16/260,288, filed Jan. 29, 2019.
Advisory Action dated Jul. 27, 2022, U.S. Appl. No. 16/260,288, filed Jan. 29, 2019.
Office Action dated Jun. 7, 2022, Brazilian Patent Application filed Sep. 8, 2017.
Office Action dated Jun. 20, 2022, Saudi Arabia Patent Application No. 520411793 filed Oct. 20, 2017.
Examiner's Answer to Appeal Brief dated Jun. 2, 2022, U.S. Appl. No. 16/219,126, filed Dec. 13, 2018.
Final Office Action dated Jun. 17, 2022, U.S. Appl. No. 16/421,138, filed May 23, 2019.
Office Action dated Aug. 19, 2022, Canadian Patent Application No. 3084911 filed Jun. 20, 2012.
Office Action dated Aug. 24, 2022, Argentine Patent Application No. 20190101360 filed May 22, 2019.
Restriction Requirement dated Aug. 23, 2022, U.S. Appl. No. 17/054,195, filed Nov. 10, 2020.
Advisory Action dated Sep. 1, 2022, U.S. Appl. No. 16/421,138, filed May 23, 2019.
Notice of Financial Consideration of Grants dated Sep. 19, 2022, Saudi Arabian Patent Application No. 51891931, filed Jan. 15, 2016.
Communication Pursuant to Rule 70(2) and 70a(2) EPC dated Sep. 6, 2022, European Patent Application No. 19895601.3 filed Dec. 12, 2019.
Office Action dated Sep. 4, 2022, Saudi Arabian Patent Application No. 520420584 filed May 22, 2018.
Notice of Allowance dated Jun. 19, 2019, U.S. Appl. No. 15/259,354, filed Sep. 8, 2016.
Office Action dated Apr. 4, 2019, U.S. Appl. No. 14/033,096, filed Sep. 20, 2013.
Office Action dated Mar. 21, 2019, Canadian Patent Application No. 2976071.
International Preliminary Report on Patentability, dated Mar. 21, 2019, PCT/US2017/0050636, filed on Sep. 8, 2017.
Mak, John, et al., "Systems and Methods for LNG Production with Propane and Ethane Recovery," filed Apr. 22, 2019, Application No.
Office Action dated Mar. 1, 2019, U.S. Appl. No. 15/259,354, filed Sep. 8, 2016.
Final Office Action dated Mar. 6, 2019, U.S. Appl. No. 15/191,251, filed Jun. 23, 2016.
Area 4, "Reboilers", found at: https://www.area4.info/Area4%20Informations/REBOILERS.htm.
Restriction Requirement dated May 12, 2017, U.S. Appl. No. 14/988,388, filed Jan. 5, 2016.
Office Action dated Aug. 10, 2017, U.S. Appl. No. 14/988,388, filed Jan. 5, 2016.
Final Office Action dated Nov. 29, 2017, U.S. Appl. No. 14/988,388, filed Jan. 5, 2016.
Notice of Allowance dated Feb. 16, 2018, U.S. Appl. No. 14/988,388, filed Jan. 5, 2016.
U.S. Appl. No. 10/469,456, Office Action, dated Sep. 19, 2005, 6 pages.
U.S. Appl. No. 10/469,456, Notice of Allowance, dated Jan. 10, 2006, 6 pages.
Europe Patent Application No. 02731911.0, Supplementary European Search Report, dated Nov. 24, 2005, 3 pages.
Europe Patent Application No. 02731911.0, Examination Report, dated Mar. 2, 2006, 5 pages.
Europe Patent Application No. 02731911.0, Examination Report, dated Sep. 19, 2006, 4 pages.
Europe Patent Application No. 02731911.0, Intention to Grant, dated Aug. 1, 2007, 20 pages.
Europe Patent Application No. 02731911.0, Decision to Grant, dated Dec. 13, 2007, 2 pages.
Canada Patent Application No. 2484085, Examination Report, dated Jan. 16, 2007, 3 pages.
First Office Action dated Dec. 14, 2007, CN Application No. 200480039552.8 filed Oct. 30, 2003.
Second Office Action dated Nov. 7, 2008, CN Application No. 200480039552.8 filed Oct. 30, 2003.
Notice of Decision to Grant dated Jul. 31, 2009, CN Application No. 200480039552.8 filed Oct. 30, 2003.
Examination Report dated Dec. 19, 2012, EP Application No. 04794213.1 filed Oct. 4, 2004.
Second Examination Report dated Oct. 7, 2014, EP Application No. 04794213.1, filed Oct. 4, 2004.
Office Action dated Jan. 7, 2009, JP Application No. 2006538016, priority date Oct. 30, 2003.
Decision to Grant dated Aug. 20, 2010, JP Application No. 2006538016, priority date Oct. 30, 2003.
Office Action dated Aug. 4, 2010, U.S. Appl. No. 10/595,528, filed Feb. 28, 2007.
Final Office Action dated Dec. 29, 2010, U.S. Appl. No. 10/595,528, filed Feb. 28, 2007.
Advisory Action dated Apr. 14, 2011, U.S. Appl. No. 10/595,528, filed Feb. 28, 2007.
Office Action dated Jun. 8, 2011, U.S. Appl. No. 10/595,528, filed Feb. 28, 2007.
Final Office Action dated Oct. 27, 2011, U.S. Appl. No. 10/595,528, filed Feb. 28, 2007.
Notice of Allowance dated Mar. 5, 2012, U.S. Appl. No. 10/595,528, filed Feb. 28, 2007.
Europe Patent Application No. 08795331.1, Communication pursuant to Rules 161 and 162 EPC, dated Mar. 24, 2010, 2 pages.
China Patent Application No. 200880103754.2, First Office Action, dated Mar. 27, 2012, 20 pages.
China Patent Application No. 200880103754.2, Second Office Action, dated Dec. 26, 2012, 21 pages.
China Patent Application No. 200880103754.2, Third Office Action, dated Jul. 22, 2013, 7 pages.
China Patent Application No. 200880103754.2, Notification to Grant Patent Right for Invention, dated Dec. 23, 2013, 2 pages.
Australia Patent Application No. 2008287322, First Examination Report, dated Apr. 8, 2011, 2 pages.
Australia Patent Application No. 2008287322, Notice of Acceptance, dated Apr. 4, 2012, 1 page.
Gulf Cooperation Council Patent Application No. GCC/P/2008/11533, Examination Report, dated Dec. 19, 2013, 4 pages.
Canada Patent Application No. 2694149, Office Action, dated Apr. 16, 2012, 2 pages.
U.S. Appl. No. 12/669,025, Office Action, dated May 8, 2012, 12 pages.

(56) References Cited

OTHER PUBLICATIONS

U.S. Appl. No. 12/669,025, Office Action, dated Oct. 10, 2013, 11 pages.
U.S. Appl. No. 12/669,025, Final Office Action, dated Mar. 4, 2014, 10 pages.
U.S. Appl. No. 12/669,025, Notice of Allowance, dated Apr. 7, 2015, 12 pages.
Mexico Patent Application No. MX/a/2010/001472, Office Action, dated Nov. 15, 2013, 1 page.
Mexico Patent Application No. MX/a/2010/001472, Office Action, dated Jul. 23, 2014, 1 page.
United Arab Emirates Patent Application No. 0143/2010, Search Report, dated Oct. 3, 2015, 9 pages.
Restriction Requirement dated Sep. 22, 2015, U.S. Appl. No. 13/996,805, filed Sep. 17, 2013.
Office Action dated Feb. 9, 2016, U.S. Appl. No. 13/996,805, filed Sep. 17, 2013.
Notice of Allowance dated Jun. 9, 2016, U.S. Appl. No. 13/996,805, filed Sep. 17, 2013.
Restriction Requirement dated Sep. 12, 2018, U.S. Appl. No. 15/259,354, filed Sep. 8, 2016.
Australian Application No. 2011349713, Examination Report, dated Dec. 16, 2014, 2 pages.
Australia Application No. 2011349713, Notice of Acceptance, dated Mar. 31, 2015, 2 pages.
Restriction Requirement dated Jan. 8, 2014, U.S. Appl. No. 13/528,332, filed Jun. 20, 2012.
Notice of Allowance dated Aug. 15, 2014, U.S. Appl. No. 13/528,332, filed Jun. 20, 2012.
Examination Report dated Mar. 17, 2016, AU Application No. 2012273028, priority date Jun. 20, 2011.
Office Action dated Sep. 22, 20202, U.S. Appl. No. 16/219,126, filed Dec. 13, 2018.
International Preliminary Report on Patentability, dated Dec. 3, 2020, PCT/US2018/033875, filed on May 22, 2018.
International Application No. PCT/US2019/065993 filed Dec. 12, 2019, PCT Search Report and Written Opinion dated Apr. 9, 2020.
Editors: Mokhatab, S.; Poe, W. A. Poe; Spe, J. G. Handbook of Natural Gas Transmission and Processing (Elsevier, 2006, ISBN U 978-0-7506-7776-9, pp. 365-400), Chapter 10, pp. 365-400.
Mak, John, et al., "Integrated Methods and Configurations for Propane Recovery in Both Ethane Recovery and Ethane Rejection," filed Nov. 10, 2020, Application No.
Mak, John, et al., "Integrated Methods and Configurations for Ethane Rejection and Ethane Recovery," filed May 22, 2018, Application No. PCT/US2018/033875.
European Patent Application No. 16884122.9, Communication pursuant to Rules 161 and 162 EPC, dated Aug. 20, 2018, 3 pages.
Foreign Communication from a Related Counterpart—International Preliminary Report On Patentability, dated Nov. 29, 2018, PCT/US2016/034362, filed on May 26, 2016.
Mak, John, "Configurations and Methods for Retrofitting NGL Recovery Plant," filed Jun. 20, 2011, U.S. Appl. No. 61/499,033.
Notice of Allowance dated Jan. 24, 2019, U.S. Appl. No. 15/158,143, filed May 16, 2016.
Foreign Communication from a Related Counterpart—International Search Report and Written Opinion, dated Dec. 12, 2017, PCT/US2017/0050636, filed on Sep. 8, 2017.
Mak, John et al., "Methods and Configuration for Retrofitting NGL Plant for High Ethane Recovery." filed Sept. 9, 2016, U.S. Appl. No. 62/385,748.
Mak, John et al., "Methods and Configuration for Retrofitting NGL Plant for High Ethane Recovery." filed Sep. 9, 2016, U.S. Appl. No. 62/489,234.
Mak, John, "Configurations and Methods for NGL Recovery for High Nitrogen Content Feed Gases," filed Jan. 29, 2019, U.S. Appl. No. 16/260,288.
Office Action dated Dec. 9, 2019, U.S. Appl. No. 15/988,310, filed May 24, 2018.
Office Action dated Dec. 3, 2019, Canadian Patent Application No. 2976071 filed Feb. 9, 2016.
Notice of Allowance dated Mar. 13, 2020, U.S. Appl. No. 15/988,310, filed May 24, 2018.
Office Action dated May 4, 2020, U.S. Appl. No. 15/789,463, filed Oct. 20, 2017.
Notice of Acceptance dated Jun. 29, 2020, United Arab Emirates Patent Application No. P1023/2015 filed Mar. 14, 2014.
Notice of Allowance dated May 19, 2020, Canadian Patent Application No. 2976071 filed Feb. 9, 2016.
International Preliminary Report on Patentability, dated Apr. 30, 2020, PCT/US2017/057674, filed on Oct. 20, 2017.
Office Action dated Jun. 28, 2018, CA Application No. 2,839,132, filed on Dec. 11, 2013.
Office Action dated Jun. 29, 2018, MX Application No. MX/A/2013/014864, filed on Dec. 13, 2013.
Notice of Allowance dated Oct. 18, 2018, MX Application No. MX/A/2013/014864, filed on Dec. 13, 2013.
Restriction Requirement dated Nov. 19, 2015, U.S. Appl. No. 14/033,096, filed Sep. 20, 2013.
Office Action dated Jun. 2, 2016, U.S. Appl. No. 14/033,096, filed Sep. 20, 2013.
Final Office Action dated Dec. 9, 2016, U.S. Appl. No. 14/033,096, filed Sep. 20, 2013.
Advisory Action dated Feb. 28, 2017, U.S. Appl. No. 14/033,096, filed Sep. 20, 2013.
Office Action dated May 11, 2017, U.S. Appl. No. 14/033,096, filed Sep. 20, 2013.
Final Office Action dated Nov. 15, 2017, U.S. Appl. No. 14/033,096, filed Sep. 20, 2013.
Advisory Action dated Feb. 6, 2018, U.S. Appl. No. 14/033,096, filed Sep. 20, 2013.
Office Action dated Mar. 26, 2018, U.S. Appl. No. 14/033,096, filed Sep. 20, 2013.
Final Office Action dated Oct. 17, 2018, U.S. Appl. No. 14/033,096, filed Sep. 20, 2013.
Office Action dated Nov. 25, 2015, U.S. Appl. No. 14/210,061, filed Mar. 14, 2014.
Notice of Allowance dated Mar. 26, 2016, U.S. Appl. No. 14/210,061, filed Mar. 14, 2014.
Office Action dated Sep. 26, 2017, U.S. Appl. No. 15/019,570, filed Feb. 6, 2016.
Notice of Allowance dated May 18, 2018, U.S. Appl. No. 15/019,570, filed Feb. 6, 2016.
Office Action dated Jul. 7, 2017, U.S. Appl. No. 15/158,143, filed May 16, 2016.
Final Office Action dated Nov. 1, 2017, U.S. Appl. No. 15/158,143, filed May 16, 2016.
Office Action dated Mar. 14, 2018, U.S. Appl. No. 15/158,143, filed May 16, 2016.
Final Office Action dated Jun. 29, 2018, U.S. Appl. No. 15/158,143, filed May 16, 2016.
Office Action dated Oct. 4, 2018, U.S. Appl. No. 15/158,143, filed May 16, 2016.
Foreign Communication from a Related Counterpart—International Search Report and Written Opinion, dated Aug. 24, 2016, PCT/US2016/013687 , filed on Jan. 15, 2016.
Foreign Communication from a Related Counterpart—International Preliminary Examination Report, dated Jul. 19, 2018, PCT/US2016/013687 , filed on Jan. 15, 2016.
International Application No. PCT/US02/16311, International Preliminary Examination Report, dated Feb. 19, 2003, 6 pages.
Foreign Communication from a Related Counterpart—International Search Report and Written Opinion, dated Feb. 16, 2005, PCT/US2004/032788, filed on Oct. 5, 2004.
Foreign Communication from a Related Counterpart—International Preliminary Report on Patentability, dated Feb. 27, 2006, PCT/US2004/032788, filed on Oct. 5, 2004.
International Application No. PCT/US08/09736, Written Opinion of the International Searching Authority, dated Nov. 3, 2008, 5 pages.
International Application No. PCT/US08/09736, International Preliminary Report on Patentability, dated May 25, 2010, 6 pages.

(56) References Cited

OTHER PUBLICATIONS

Foreign Communication from a Related Counterpart—International Search Report and Written Opinion, dated Apr. 18, 2012, PCT/2011/065140, filed on Dec. 15, 2011.
Foreign Communication from a Related Counterpart—International Preliminary Report on Patentability, dated Jun. 25, 2013, PCT/2011/065140, filed on Dec. 15, 2011.
Foreign Communication from a Related Counterpart—International Search Report and Written Opinion, dated Jul. 21, 2013, PCT/US2012/043332, filed Jun. 20, 2012.
Foreign Communication from a Related Counterpart—International Preliminary Report on Patentability, dated Jan. 4, 2015, PCT/US2012/043332, filed Jun. 20, 2012.
Foreign Communication from a Related Counterpart—International Search Report and Written Opinion, dated Jan. 14, 2014, PCT/US2013/060971, filed Sep. 20, 2013.
Foreign Communication from a Related Counterpart—International Preliminary Report on Patentability, dated Jan. 7, 2015, PCT/US2013/060971, filed Sep. 20, 2013.
Foreign Communication from a Related Counterpart—International Search Report and Written Opinion, dated Jul. 1, 2016, PCT/US2016/017190, filed Feb. 6, 2016.
Foreign Communication from a Related Counterpart—International Preliminary Report on Patentability, dated Aug. 24, 2017, PCT/US2016/017190, filed Feb. 6, 2016.
Foreign Communication from a Related Counterpart—International Search Report and Written Opinion, dated Jul. 7, 2014, PCT/US2014/026655, filed on Mar. 14, 2014.
Foreign Communication from a Related Counterpart—International Preliminary Report on Patentability, dated Sep. 15, 2015, PCT/US2014/026655, filed on Mar. 14, 2014.
Foreign Communication from a Related Counterpart—International Search Report and Written Opinion, dated Dec. 8, 2016, PCT/US2016/034362, filed on May 26, 2016.
Foreign Communication from a Related Counterpart—International Search Report and Written Opinion, dated May 1, 2018, PCT/US2017/057674, filed on Oct. 20, 2017.
Foreign Communication from a Related Counterpart—International Search Report and Written Opinion, dated Jul. 23, 2018, PCT/US2018/033875, filed on May 22, 2018.
Mak, John, "Flexible NGL Recovery and Methods," filed Oct. 20, 2003, U.S. Appl. No. 60/516,120.
Mak, John, "Ethane Recovery and Ethane Rejection Methods and Configurations," filed Dec. 23, 2010, U.S. Appl. No. 61/426,756.
Mak, John, "Ethane Recovery and Ethane Rejection Methods and Configurations," filed Jan. 21, 2011, U.S. Appl. No. 61/434,887.
Mak, John, "Configurations and Methods for NGL Recovery for High Nitrogen Content Feed Gases," filed Sep. 20, 2012, U.S. Appl. No. 61/703,654.
Mak, John, "Flexible NGL Recovery Methods and Configurations," filed Mar. 14, 2013, U.S. Appl. No. 61/785,329.
Mak, John, "Methods and Configuration of an NGL Recovery Process for Low Pressure Rich Feed Gas," filed Feb. 9, 2015, U.S. Appl. No. 62/113,938.
Mak, John, "Phase Implementation of Natural Gas Liquid Recovery Plants," filed Oct. 20, 2017, U.S. Appl. No. 15/789,463.
Mak, John, "Phase Implementation of Natural Gas Liquid Recovery Plants," filed Oct. 20, 2017, International Application No. PCT/US2017/057674.
Extended European Search Report dated Aug. 8, 2019, European Patent Application No. 16884122.9.
Communication Pursuant to Rules 70(2) and 70a(2) EPC dated Aug. 27, 2019, European Patent Application No. 16884122.9.
Corrected Notice of Allowability dated Jul. 2, 2019, U.S. Appl. No. 15/259,354, filed Sep. 8, 2016.
Office Action dated Jun. 14, 2019, Canadian Application No. 2,839,132, filed on Dec. 11, 2013.
Notice of Decision dated Sep. 30, 2019, United Arab Emirates Patent Appication No. P1023/2015 filed Mar. 14, 2014.
Extended European Search Report dated Aug. 1, 2018, European Patent Appication filed Feb. 9, 2016.
Communication Pursuant to Rules 70(2) and 70a(2) EPC dated Aug. 20, 2018, European Patent Application filed Feb. 9, 2016.
Restriction Requirement dated Sep. 18, 2019, U.S. Appl. No. 15/789,463, filed Oct. 20, 2017.
Examination Report dated Jul. 9, 2020, European Patent Application No. 167497733.9 filed Feb. 9, 2016.
PCT International Preliminary Reporton Patentability dated Jun. 24, 2021; International Application No. PCT/US2019/065993 filed Dec. 12, 2019.
Final Office Action dated Aug. 9, 2021, U.S. Appl. No. 16/219,126, filed Dec. 13, 2018.
Restriction Requirement dated Aug. 9, 2021, filed Jan. 29, 2019, U.S. Appl. No. 16/260,288.
Office Action dated Apr. 13, 2021, Saudi Arabian Patent Application No. 51891931, filed Jan. 15, 2016.
Notice of Allowance dated Apr. 27, 2021, U.S. Appl. No. 15/789,463, filed Oct. 20, 2017.
Office Action dated Jan. 29, 2021, U.S. Appl. No. 16/219,126, filed Dec. 13, 2018.
Office Action dated Feb. 24, 2021, Canadian Patent Application No. 3008229 filed Jan. 15, 2016.
Pre-Brief Appeal Decision dated Oct. 20, 2022, U.S. Appl. No. 16/260,288, filed Jan. 29, 2019.
Examiner's Answer dated Jan. 18, 2023, U.S. Appl. No. 16/260,288, filed Jan. 29, 2019.
Notice of Acceptance dated Oct. 27, 2022, Australian Patent Application filed May 18, 2016.
Notice of Allowance dated Nov. 15, 2022, Canadian Patent Application No. 3022085 filed May 18, 2016.
Office Action dated Nov. 1, 2022, Brazilian Patent Application filed Sep. 8, 2017.
Notice of Allowance dated Nov. 17, 2022, Canadian Patent Application No. 3047703 filed Feb. 9, 2017.
Notice of Grant dated Dec. 27, 2022, Saudi Arabia Patent Application No. 520411793 filed Oct. 20, 2017.
Restriction Requirement dated Sep. 22, 2022, U.S. Appl. No. 17/393,477, filed Aug. 4, 2021.
Notice of Non-Compliant Amendment dated Nov. 17, 2022, U.S. Appl. No. 17/393,477, filed Aug. 4, 2021.
Office Action dated Oct. 27, 2022, U.S. Appl. No. 17/054,195, filed Nov. 10, 2020.
Examiner's Answer to Appeal Brief dated Feb. 14, 2023, U.S. Appl. No. 16/421,138, filed May 23, 2019.

* cited by examiner

METHODS AND CONFIGURATION FOR RETROFITTING NGL PLANT FOR HIGH ETHANE RECOVERY

CROSS-REFERENCE TO RELATED APPLICATIONS

The present application claims priority to and is the National Stage of International Application No. PCT/US2017/050636 filed Sep. 8, 2017 by Mak et al. and entitled "Methods and Configuration for Retrofitting NGL Plant for High Ethane Recovery" which claims priority to U.S. Provisional Patent Application Serial No. 62,385,748 filed Sep. 9, 2016 by Mak et al. and entitled "Methods and Configuration for Retrofitting NGL Plant for High Ethane Recovery," and to U.S. Provisional Patent Application Serial No. 62,489,231 filed Apr. 24, 2017 by Mak et al. and entitled "Methods and Configuration for Retrofitting NGL Plant for High Ethane Recovery," all of which are incorporated herein by reference as if reproduced in their entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Natural gas liquids (NGL) may describe heavier gaseous hydrocarbons: ethane (C2H6), propane (C3H8), normal butane (n-C4H10), isobutane (i-C4H10), pentanes, and even higher molecular weight hydrocarbons, when processed and purified into finished by-products. Systems can be used to recover NGL from a feed gas using natural gas liquids plants.

SUMMARY

In an embodiment, a natural gas liquid plant bolt-on unit may comprise an absorber configured to condense the ethane content from an overhead gas stream from a demethanizer using a cold lean residue gas to produce a liquid portion and a vapor portion, wherein the liquid portion is configured to provide a reflux to the demethanizer, and the vapor portion is configured to provide cooling of a reflux exchanger and a subcooler; and a flow control valve configured to pass about 70% to 90% of the vapor portion to reflux cooling and reflux of the demethanizer in the subcooler.

In an embodiment, a method may comprise passing an overhead vapor stream from a demethanizer to an absorber; contacting the overhead vapor stream with a cold lean residue gas to produce a liquid portion and a vapor portion within the absorber; passing the liquid portion back to the demethanizer as reflux; and passing the vapor portion to a subcooler, wherein the subcooler cools at least a first portion of the vapor portion to produce the cold lean residue gas.

In an embodiment, a method may comprise passing an overhead vapor stream from a demethanizer to a first heat exchanger; cooling a compressed cooled residue gas using at least a first portion of the overhead vapor stream from the demethanizer in the first heat exchanger; compressing the first portion of the overhead vapor stream downstream of the first heat exchanger to produce a compressed vapor portion; cooling the compressed vapor portion to produce the compressed cooled residue gas that passes to the first heat exchanger; passing the compressed cooled residue gas to a pressure reduction device to produce a cold lean residue gas; and passing the cold lean residue gas to the demethanizer as reflux.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
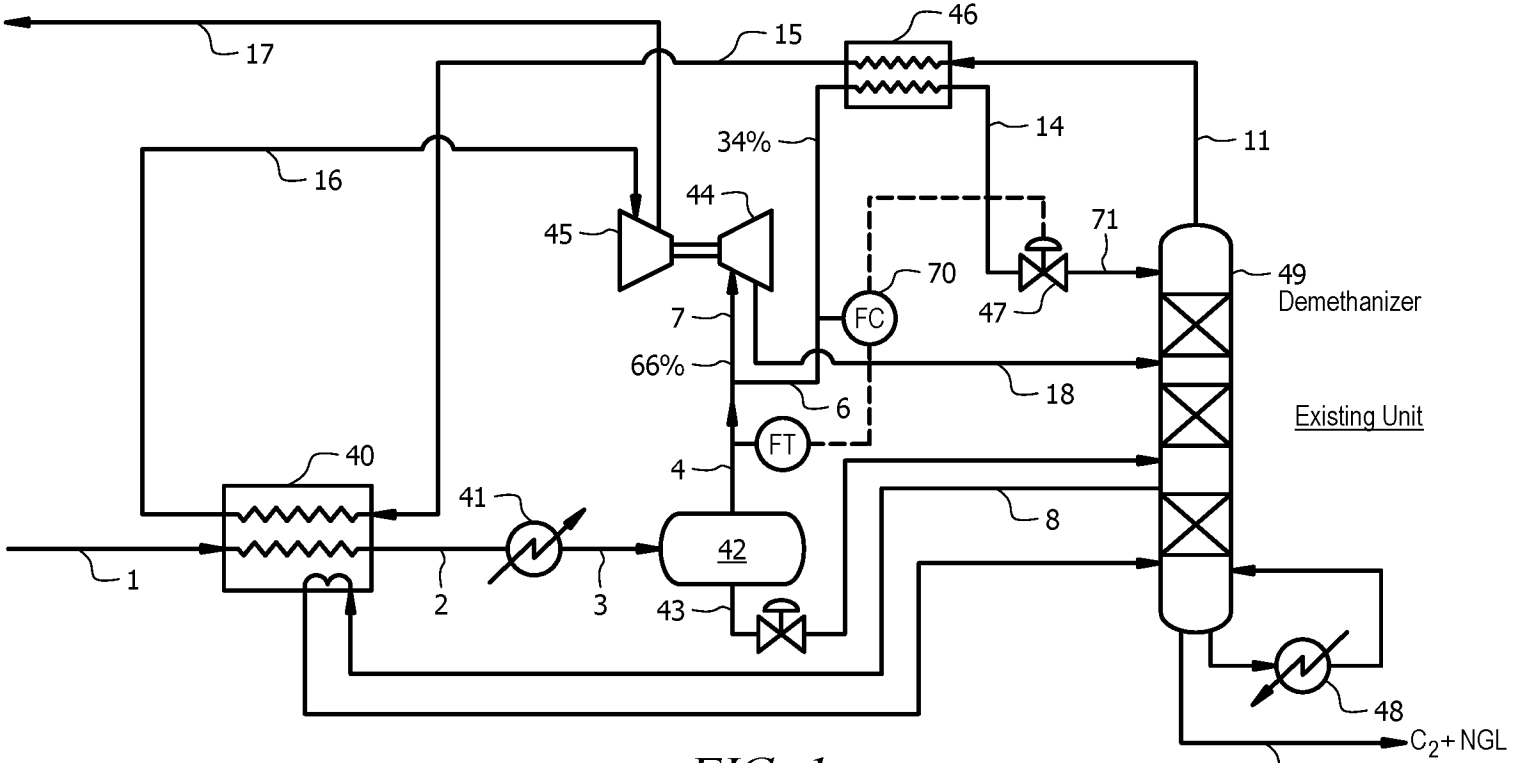
FIG. 1 (Prior Art)
FIG. 1 illustrates a typical NGL plant.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or "approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

All references to percentages of flow refer to volumetric percentages unless otherwise indicated.

The field of the present disclosure is natural gas liquids plants, and especially relates to retrofitting natural gas liquids plants for high ethane recovery. The present systems and methods relate to the recovery of ethane, propane, and heavier hydrocarbons from the natural gas stream. A typical shale gas may contain 78% methane, 9% ethane, 5.8% ethane, and the balance butane and heavier hydrocarbons, as shown below in Table 1.

TABLE 1

Heat and Material Balance

| Stream Description | Feed Gas | Demethanizer Overhead | Reflux to Absorber | Absorber bottom | Residue Gas | NGL |
|---|---|---|---|---|---|---|
| Stream Number | 1 | 11 | 69 | 64 | 17 | 12 |
| Mole % | | | | | | |
| N2 | 0.52 | 0.58 | 0.66 | 0.18 | 0.66 | 0.00 |
| C1 | 77.84 | 98.05 | 99.19 | 92.56 | 99.19 | 0.40 |
| C2 | 8.94 | 1.30 | 0.15 | 6.86 | 0.15 | 50.17 |
| C3 | 5.78 | 0.07 | 0.00 | 0.38 | 0.00 | 32.85 |
| IC4 | 0.81 | 0.00 | 0.00 | 0.01 | 0.00 | 4.60 |
| NC4 | 1.40 | 0.00 | 0.00 | 0.01 | 0.00 | 7.96 |
| IC5 | 0.25 | 0.00 | 0.00 | 0.00 | 0.00 | 1.42 |
| NC5 | 0.30 | 0.00 | 0.00 | 0.00 | 0.00 | 1.70 |
| C6 | 0.11 | 0.00 | 0.00 | 0.00 | 0.00 | 0.63 |
| C7 | 0.04 | 0.00 | 0.00 | 0.00 | 0.00 | 0.23 |
| C8 | 0.01 | 0.00 | 0.00 | 0.00 | 0.00 | 0.06 |
| Pressure, psig | 1,153 | 445 | 470 | 445 | 654 | 447 |
| Temperature, ° F. | 77 | −129 | −141 | −134 | 120 | 110 |
| Flow, MMscfd | 199.6 | 189.0 | 52.3 | 32.6 | 156.5 | 35.1 |

The richness of the feed gas and its high liquid content would potentially generate revenue from gas processing. However, due to the cyclic price fluctuation of natural gas and the natural gas liquids (NGLs), especially ethane liquid, gas processors must decide on the optimum level of NGL recovery that makes economic sense. Consequently, there is a demand for processes that require low capital investment that can also be upgraded for higher recoveries when the price of NGLs becomes more attractive in the future. Therefore, there are needs for efficient recoveries of these products and processes that can provide efficient recoveries with lower capital investment. Available processes for separating these materials include those based upon cooling and refrigeration of gas, such as oil absorption and/or refrigerated oil absorption. Additionally, cryogenic processes have gained popularity because of the availability of advanced turbo-expander equipment to produce power while generating refrigeration for the cryogenic process.

The cryogenic expansion process is now generally preferred for natural gas liquids recovery because it provides flexibility, efficiency, and reliability. There are numerous patented processes that can be used to meet the varying degrees of recovery.

Most of the NGL recovery processes are based on the use of feed gas in refluxing the absorber. These processes are simple with an ease of operation and have low equipment counts. The relatively low investment can be justified by the NGL produced. These plants are based on the feed gas reflux process coupled with turbo-expander for cooling and power production and can achieve 70% to 80% ethane recovery. The level of recovery depends on a number of factors including feed gas composition, feed gas supply pressure, and/or availability of refrigeration.

To meet ethane recovery higher than 80%, reflux processes using lean residue gas can be used. The residue gas is compressed to a higher pressure, cooled and expanded to generate deep cooling to the demethanizer However, these processes require additional compression and heat exchanger equipment that must be justified by the additional NGL production. In most cases, the power for recycle compression cannot justify the revenues from additional production, especially when ethane values remain unattractive.

However, with improving pricing of the ethane commodity as a feedstock to petrochemical plants, there is a drive for gas processors to produce ethane liquid for sales. Existing plants can be retrofitted with residue gas reflux, such as U.S. Pat. No. 8,910,495 to Mak. Such modification would require re-engineering of the existing system which would require significant capital investment. The plant revamp also requires extensive shutdown of the existing facility, which will result in revenue losses from liquid and gas production. In most instances, an extensive revamp of the existing facility cannot be justified for the increase in NGL production.

The contemplated systems and methods present an economical and effective solution that can be implemented with the existing facility to increase ethane recovery from current levels to about or greater than 95% and most preferably 99% using an add-on (or bolt-on) unit that can eliminate extensive downtime of the facility. Any unit that is described as an "add-on" unit may in some embodiments comprise a unit that can be connected to (e.g., bolted onto, etc.) the existing units, which can be referred to as a "bolt-on" unit.

From a green field installation standpoint, the NGL recovery process can be designed with a moderate ethane recovery process, while investment of the bolt-on unit for high recovery can be deferred until the ethane market becomes more attractive. This approach will conserve capital for the project by delaying investment for high recovery to the future.

FIG. 1 illustrates a typical NGL process employed by the gas processing industry for recovering ethane NGL, known as the gas subcooled process (also known as the GSP process). As shown in FIG. 1, a dried feed gas stream 1, typically at about 800 to 1000 psig and about 80 to 100° F., can be cooled by a cold residue gas stream 15 in feed exchanger 40, forming stream 2. Stream 2 may be further cooled by propane refrigeration in chiller exchanger 41, forming stream 3, typically at −25 to −30° F. The two phase stream 3 may be separated in cold separator 42 into a vapor stream 4 and a liquid stream 43. The vapor stream 4 from the separator 42 can be split into two portions; stream 7 and stream 6.

In the GSP process, the flow ratio of stream 7 to the total flow (stream 4) is typically controlled at about 66% to turbo-expander 44 by a flow ratio controller 70. Stream 7 can be expanded across the turbo-expander 44 to provide a cooling stream 18 to the demethanizer 49. The remaining flow, stream 6, is cooled in the subcool exchanger 46 by the cold residue gas stream (or overhead gas stream) 11 to form a subcooled liquid stream 14 (which may be also known as a reflux stream 14) at about −130 to −150° F., which is further letdown in pressure in a Joule Thomson (JT) valve 47, producing a cold reflux stream 71 to the demethanizer 49. Flashed liquid stream 43, from cold separator 42, is fed to the lower section of the demethanizer 49, where the demethanizer column 49 typically operates at about 210 to 350 psig. The demethanizer 49 may be heated with a side reboiler using a column side-draw, stream 8, in feed exchanger 40, and a bottom reboiler 48. The NGL product in the demethanizer 49 is heated to remove its methane content to meet the 1 volume % methane specification. The demethanizer 49 produces an overhead gas stream 11, and an ethane rich NGL stream 12. The overhead gas stream 11 passes through subcool exchanger 46, producing stream 15, and feed exchanger 40, producing stream 16 which is further compressed by compressor 45 using power generated by turbo-expansion, producing residue gas stream 17.

Such configurations can recover 80% to 88% of the ethane content in the feed gas; the recovery levels depend on the feed gas composition, feed supply pressure, and demethanizer pressure. While lowering the demethanizer pressure can increase ethane recovery, the end result is marginal and is typically not justified due to the high gas compression cost.

Thus, although various configurations and methods for higher ethane recovery from natural gas are known in the art, all or almost all of them suffer from one or more disadvantages. Therefore, there is still a need for configurations and methods for ethane recovery, especially in retrofitting an NGL plant.

The present systems and methods are directed to retrofitting natural gas liquid plants with a bolt-on unit that can increase ethane recovery from the current levels to at or above about 95%, and most preferably at or above about 98% to 99%. As used herein, a bolt-on unit can include a unit that is intended to be added to an existing unit to retrofit the existing configuration. While referred to as a bolt-on unit, such a unit may not physically require bolts or be limited to simply being connected onto an existing unit without changing the flow configuration. In addition, the term bolt-on unit can also refer to a portion of a new unit being constructed from scratch.

The contemplated process includes an absorber operating at between about a 10° F. to about a 20° F. lower temperature than the existing demethanizer, typically at −165 to −170° F., using compression and expansion of the residue gas as the reflux to the absorber.

In one aspect, the absorber receives feed gas from the existing demethanizer, condenses its ethane content by refluxing with the cold residue gas to produce a lean overhead and a bottom ethane rich liquid that, in turn, is used as reflux to the existing demethanizer.

In another aspect, the absorber produces a residue gas that is compressed, cooled, condensed, and subcooled, producing a cold lean reflux liquid to be used in the absorber.

In another aspect, where the facility has limited space to allow installation of a new absorber, the cold lean reflux liquid is mixed with the feed gas reflux from the existing demethanizer, and fed to the demethanizer as a combined reflux, eliminating the need for a new absorber. This configuration requires minimum down-time for the installation of one heat exchanger, and does not require modification of the existing demethanizer. This process can achieve an ethane recovery of at least about 97%.

In yet another aspect, where the demethanizer can be revamped in a way that allows for feeding the cold lean reflux liquid to the top tray, which is installed at least 4 trays above the existing feed gas reflux tray, ethane recovery can be increased up to about 99%. This configuration may require some downtime for modification of the existing demethanizer column, but the higher ethane recovery may justify the downtime and cost on revamping the demethanizer.

From another perspective, the process can employ a refluxed absorber located downstream of the existing demethanizer to recover the residual ethane and propane from the feed gas, which can improve ethane recovery from 80% up to about 99% and propane recovery from 95% up to about 99%.

From another perspective, the process employs a high pressure recycled cold reflux stream that is mixed with feed gas reflux to the existing demethanizer, to lower the reflux temperature, allowing ethane recovery to be improved from 80% up to about 97%, without changes to the existing demethanizer Where revamping the existing demethanizer is a viable option, the recycle cold reflux stream can be fed as a top reflux to the existing demethanizer, further improving ethane recovery up to 99%.

In another contemplated system, the absorber overhead vapor is first used to cool the compressed residue gas (cold end) to produce a cold reflux to the absorber, and then split into two portions. About 10% to about 30% can be used to cool the compressed residue gas (warm end) and the remaining portion of about 70% to about 90% can be used to cool the feed gas in the subcool exchanger in the existing unit. The split flow ratio can be adjusted as needed to meet the ethane recovery levels.

The following figures describe embodiments of the bolt-on unit configured to increase ethane recovery of an existing NGL plant from the current levels, typically at about 80% to 90%, to a higher recovery of up to about 95%, or preferably up to about 98%, or most preferably up to about 99% ethane recovery.

Figure 2:
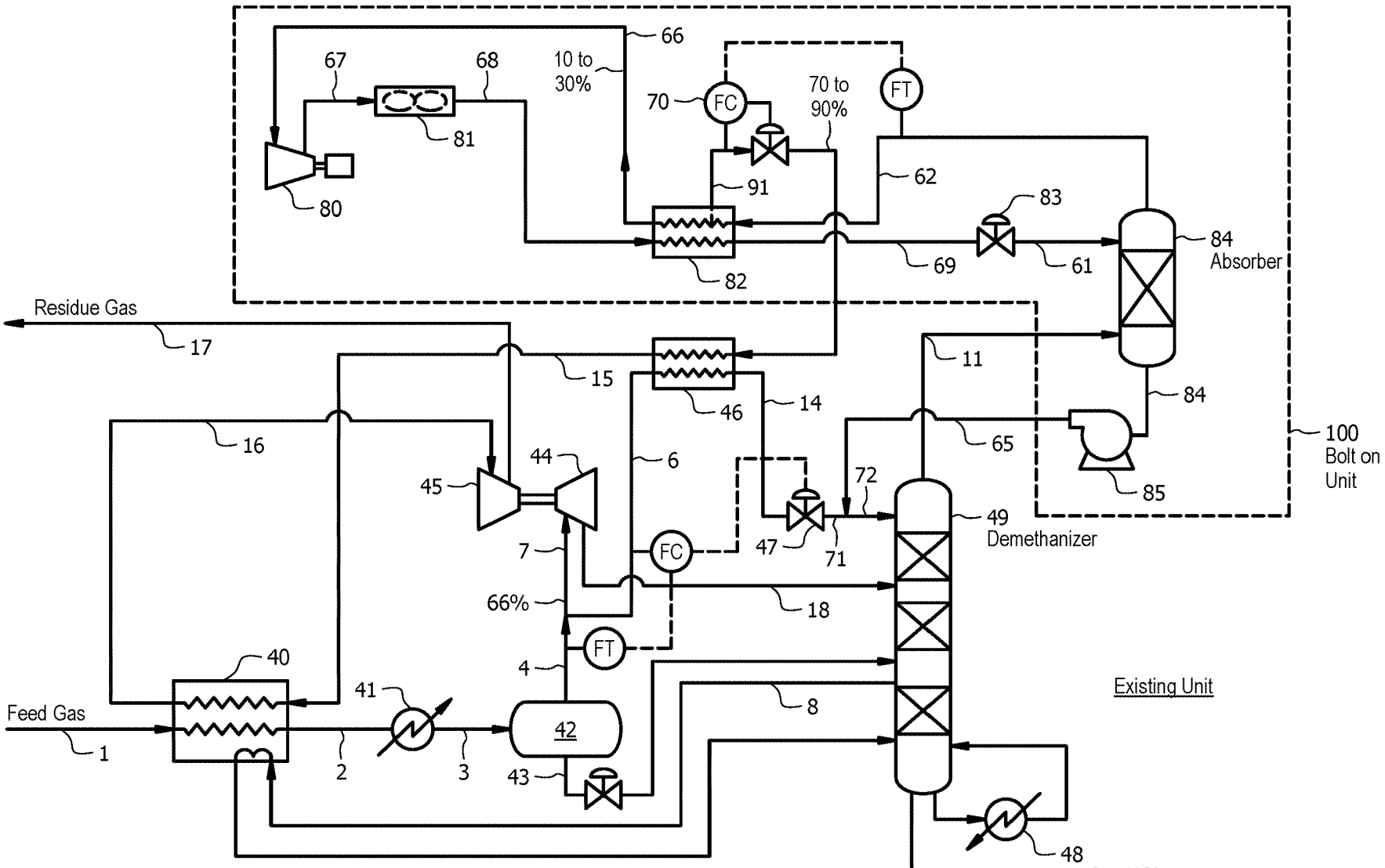
FIG. 2 illustrates a bolt-on unit for use with an NGL plant.

An embodiment of a bolt-on unit 100 is depicted in FIG. 2. The bolt-on unit 100 may be used with the system as described in FIG. 1, where only the new parts of the system are described below. The remaining portions can be the same as or similar to those described with respect to the elements shown in FIG. 1, and the description of those elements is hereby repeated. As shown in FIG. 2, the feed stream to the bolt-on unit 100 is the overhead gas stream 11 from existing demethanizer 49.

Stream 11 can be routed to absorber 84 in which a residue gas stream 69 (which may also be known as a reflux stream 69 to the absorber 84) is letdown in pressure and cooled, providing a reflux stream to the absorber 84. As is generally known, an absorber provides contact between a rising vapor phase and a falling liquid phase with heat and mass transfer between the two phases along the length of the absorber. The absorber 84, operating at a pressure slightly lower than the demethanizer 49, can produce an overhead vapor stream 62 and a bottom liquid stream 64. The bottom ethane rich liquid stream 64 can be pumped by pump 85 forming stream 65 which can be mixed with the cold reflux stream 71 from subcool exchanger 46 and fed as a combined reflux 72 to the demethanizer 49. In some embodiments, the stream 65 can be introduced into the demethanizer 49 as a stream separate from the cold reflux stream 71.

The refrigerant content in the absorber overhead vapor stream 62 can be recovered in an efficient manner, with the cold end of the heat release curve used to cool the residue gas stream 69 in reflux exchanger 82 to produce the low temperature reflux stream 61 to the absorber 84, while the warm end of the heat release curve is used to cool the warm end of the residue gas cooling curve, and to cool the feed gas stream 15 to provide reflux to the demethanizer 49.

The portion 66 (i.e. heated absorber vapor stream 66) of the absorber overhead vapor stream 62 passing to the recycle compressor 80 can be controlled at about 10% to about 30% of total flow (flow ratio of stream 66 to stream 62) using a flow ratio controller 70. The remaining portion 91 of the absorber overhead vapor stream 62 can be about 70% to about 90% of the absorber overhead vapor stream 62, and the remaining portion 91 may be routed through exchangers 46 and 40 and further compressed by compressor 45 using power generated by turbo-expansion, producing residue gas stream 17.

Figure 3:
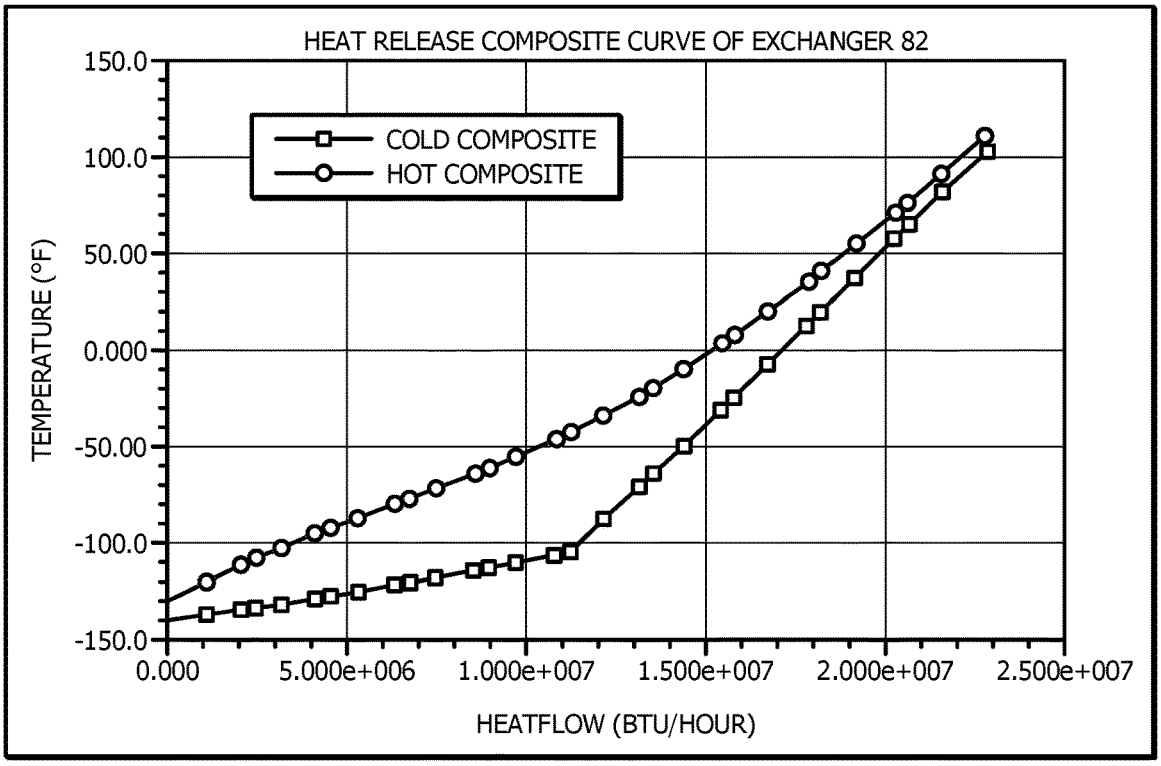
FIG. 3 is the heat composite curve of a reflux exchanger.
Figure 4:
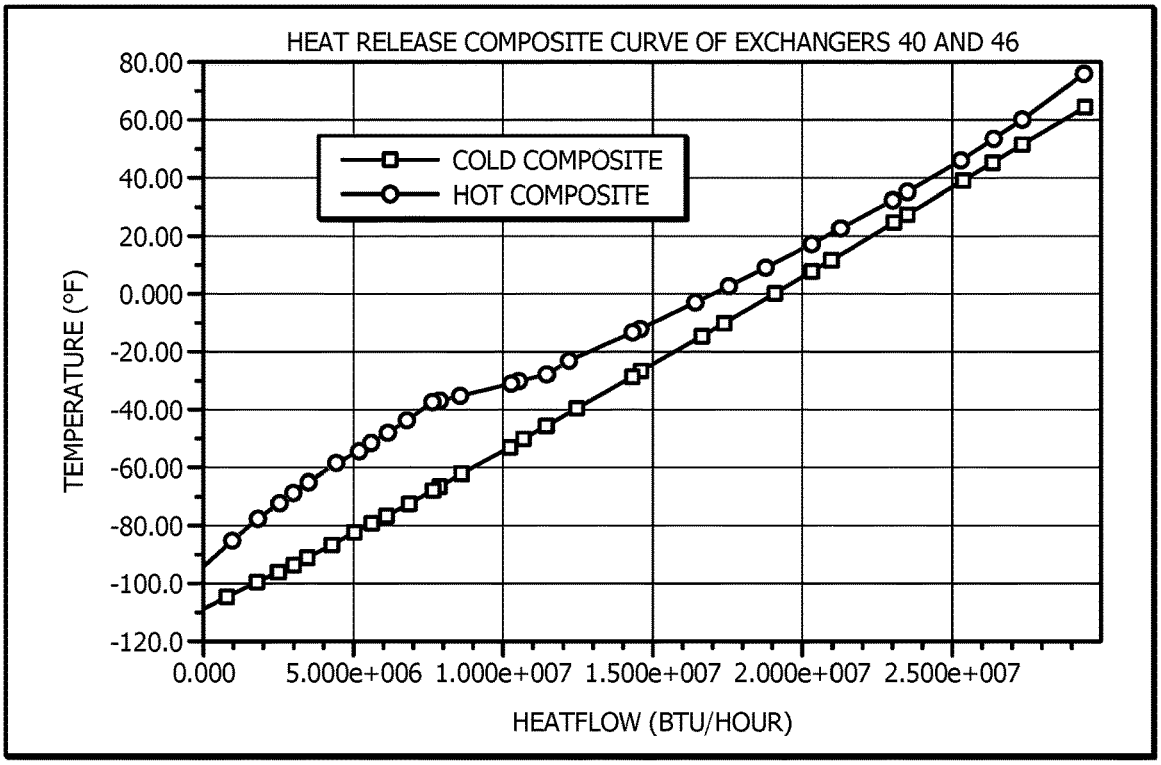
FIG. 4 is the heat composite curve of a feed exchanger and a subcool exchanger.

The effective heat release curves are shown in FIG. 3 for the reflux exchanger 82 and FIG. 4 for the feed and subcool exchangers 40 and 46 in the configurations they are shown in FIG. 2.

The heated absorber vapor stream 66 can be compressed by compressor 80 to form the high pressure stream 67, which is cooled in air cooler 81 to form stream 68 and further cooled in reflux exchanger 82 to form residue gas stream 69. The cold, high pressure residue gas stream 69 can be letdown in pressure in a JT valve 83 to produce the lean reflux stream 61 to the absorber 84.

As an example of suitable conditions of the process shown in FIG. 2, the demethanizer 49 can operate at about 230 to about 350 psig and at a temperature between about −125 to about −165° F. The non-bolt-on portion of the NGL plant can be designed to process an inlet feed gas flow of about 200 million metric standard cubic feet per day (MMscfd) and recover about 80% of its ethane content. The residue stream 69 can be letdown to about 230 to 250 psig and cooled, providing the reflux stream to the absorber 84. The absorber 84, which can operate at a pressure slightly lower than the demethanizer 49, can produce an overhead vapor stream 62 at about −140° F. to −175° F. and a bottom liquid stream 64. The heated absorber vapor stream 66, which can be at about 100° F., can be compressed by compressor 80 to about between about 1200 psig to about 1500 psig to form the high pressure stream 67.

Figure 5:
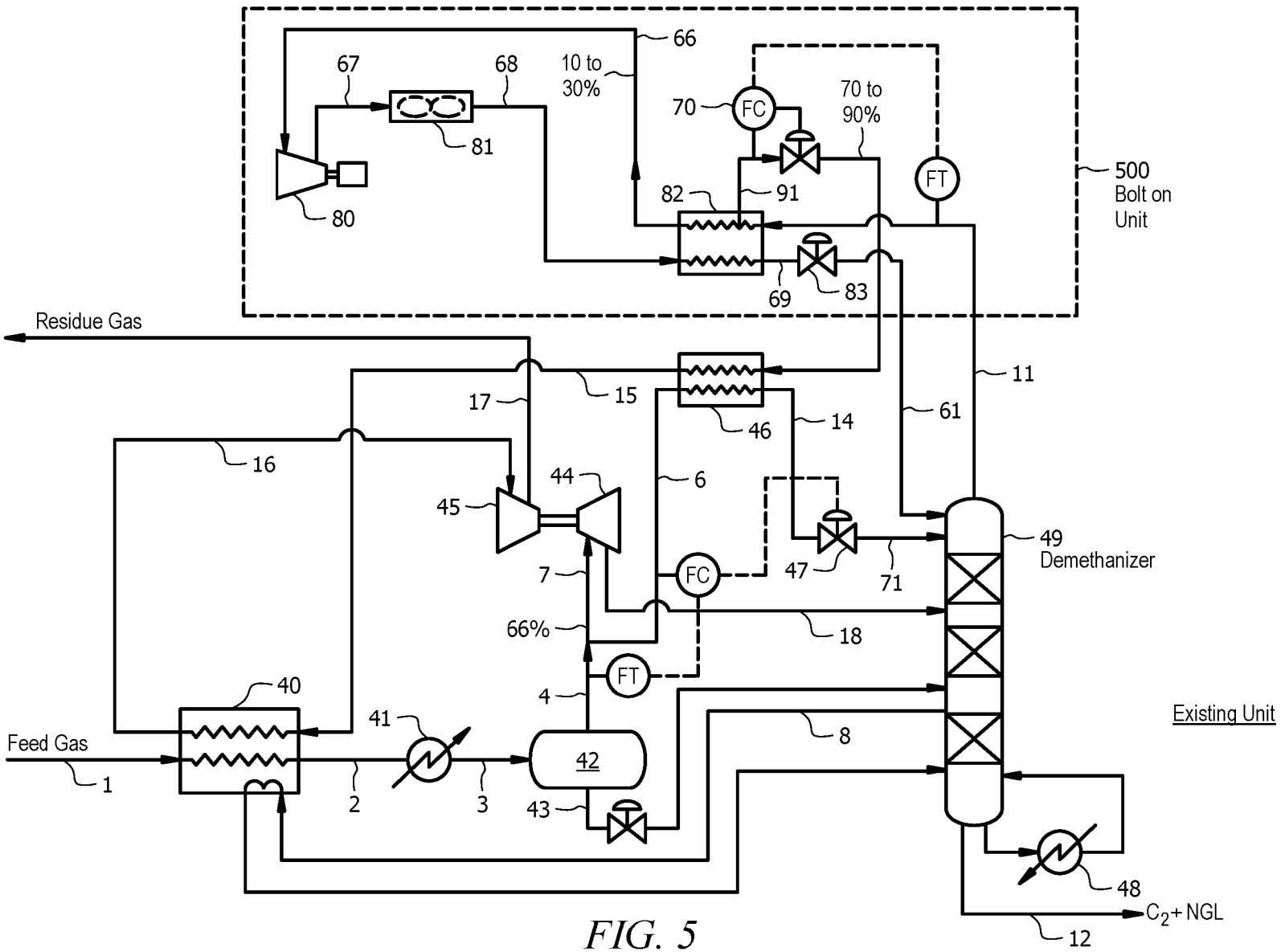
FIG. 5 illustrates a bolt-on unit with a revamped demethanizer for use with an NGL plant.

FIG. 5 provides an alternate configuration of a bolt-on unit 500 that can reduce the cost of the bolt-on unit 500 by integrating the functionality of the absorber system into the demethanizer 49. The bolt-on unit 500 may be used with the system as described in FIG. 1 and/or FIG. 2, where only the new parts of the system are described below, and the description of the elements shown in FIG. 1 is hereby repeated. This alternative can eliminate the absorber 84 and reflux pump 85 (described in FIG. 2), providing the existing demethanizer column 49 can be revamped for the higher throughput. The remaining components can be the same or similar to those components described with respect to FIG. 2. The low temperature reflux stream 61 may be fed directly to the demethanizer 49, and the overhead gas stream 11 may be fed directly to the reflux exchanger 82. Additionally, the reflux stream 61 may not be combined with the reflux stream 71 before it is fed to the demethanizer 49. This alternative can recover up to about 99% ethane. In some embodiments, the existing demethanizer 49 can be modified to include a reflux nozzle for the reflux stream 61 when the reflux stream 61 is injected directly into the demethanizer 49. This alternative can reduce the equipment count and the capital and installation cost of the bolt-on unit 500.

Figure 6:
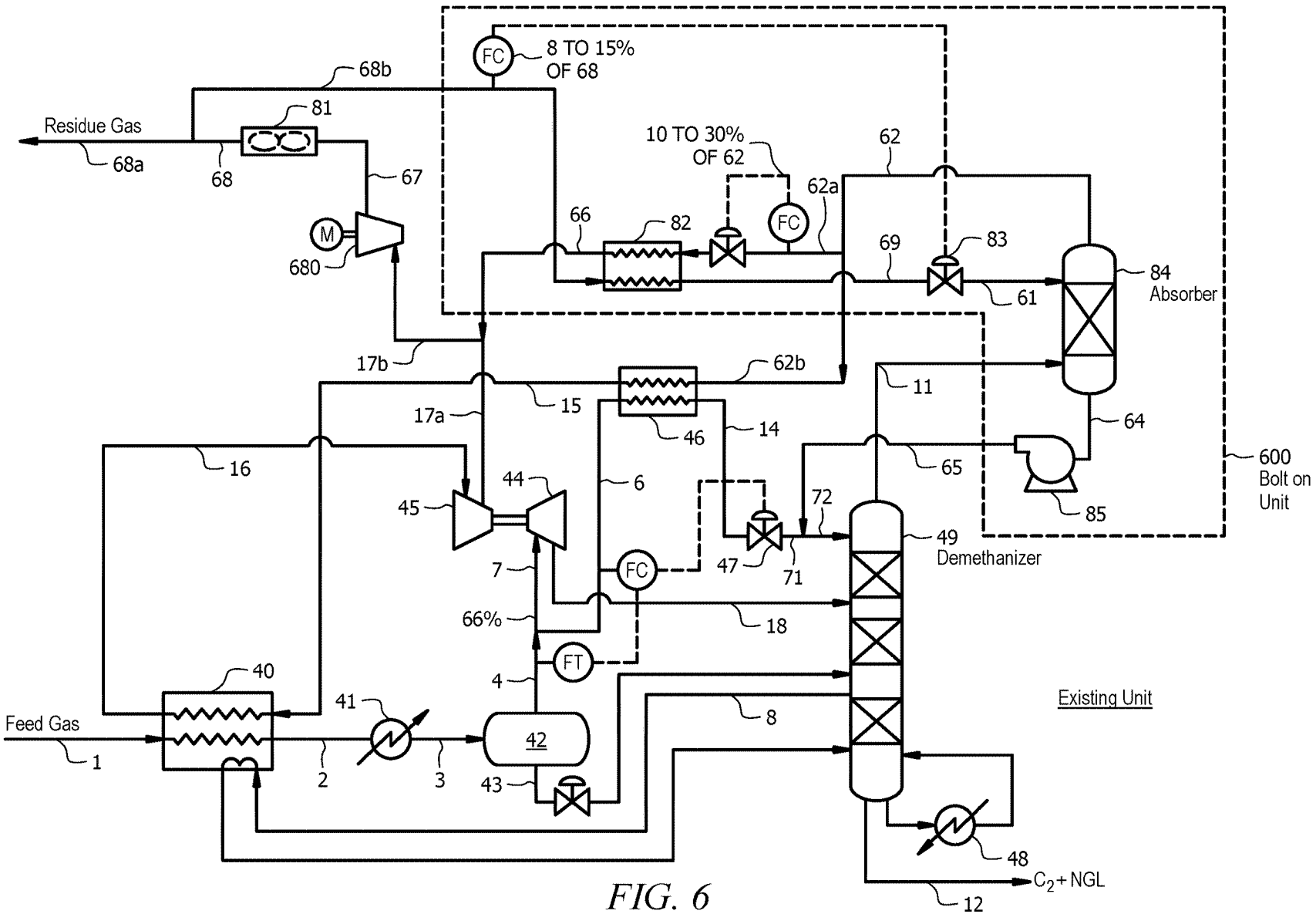
FIG. 6 illustrates a bolt-on unit utilizing an existing residue gas compressor for use with an NGL plant.

Referring to FIG. 6, in some embodiments, the residue gas stream 17*a* (as described as stream 17 in FIG. 1) may be further compressed using a residue gas compressor 680. The bolt-on unit 600 may be used with the system as described in FIG. 1 and FIG. 2, where only the new parts of the system are described below, and the description of the elements shown in FIG. 1 is hereby repeated. This residue gas stream 17*a* from the existing unit can be mixed with the heated absorber vapor stream 66 from the bolt-on unit 600. FIG. 6 provides an alternate configuration where the residue gas compressor 680 has extra capacity, and the compressor 680 can be used for the gas recycle function, avoiding the need for a new gas compressor 80 (as described in FIGS. 2 and 3), which would improve the economics of the installation. The higher ethane recovery would also result in a reduction in the ethane component in the residue gas which would free up capacity for gas recycling.

The bolt-on unit 600 may comprise the recycle reflux exchanger 82, absorber 84 and pump 85, as described above in Figured 2. The high-pressure residue gas compressor 680 may produce stream 67 which may be cooled by air cooler 81, producing discharge stream 68 which is split into two portions as described more herein. A first portion having about 8 to 15% (recycle stream 68*b*) can be routed to reflux exchanger 82, cooled and condensed to form residue gas stream 69, which is then letdown in pressure in valve 83 producing a reflux stream 61, and fed to the absorber 84. The operating pressure of the absorber 84 can depend on the operating pressure of the existing demethanizer 49. The absorber 84 is fed by the overhead gas stream 11 from the demethanizer 49, and can produce an ethane depleted overhead vapor stream 62 and a bottom ethane rich liquid stream 64. The bottom liquid can be pumped by pump 85 to form stream 65, which can be mixed with the reflux stream 71 from subcool exchanger 46 and fed as a combined reflux 72 to the demethanizer 49. The absorber overhead vapor stream 62 can be split into two portions: stream 62*a* and 62*b*. About 10 to 30% of absorber overhead vapor stream 62 can be used to form stream 62*a*, which provides cooling to the recycle stream 68*b*. The other stream 62b, at about 70% to 90% of absorber overhead vapor stream 62, can be fed to subcool exchanger 46 producing stream 15, which can be fed to feed exchanger 40 to produce stream 16. Stream 16 can be further compressed by compressor 45 using power generated by turbo-expansion to produce product gas stream 17*a*. The heated absorber vapor stream 66 can be combined with stream 17*a*, forming stream 17*b*, which can be compressed by compressor 680 to form the high pressure stream 67, which can be cooled in air cooler 81 to form stream 68. Stream 68 may be split, forming the recycle stream 68*b* (the first portion of the high-pressure residue gas compressor discharge stream, as described above) and the product residue gas stream 68*a*. With this configuration, up to or over about 99% of the ethane content from the feed gas can be recovered.

As an example of suitable conditions of the process shown in FIG. 6, the first portion (recycle stream) 68*b* of the discharge stream 68 can be routed to reflux exchanger 82, cooled and condensed to between about −115° F. to −135° F. to form residue gas stream 69, which is then letdown in pressure in valve 83 to produce the reflux stream 61, at about −160° F. to −175° F. The operating pressure of the absorber 84 can be between about 200 to 350 psig. The demethanizer 49 can operate at about −160° F., and can produce the ethane depleted overhead vapor stream 62 at about −170° F. The heated absorber vapor stream 66, which can be at about 60 to 100° F., can be combined with stream 17*a*, forming stream 17*b*, which can be compressed by compressor 680 to about between about 850 psig to about 1200 psig to form the high pressure stream 67, which can be cooled in air cooler 81 to form stream 68. With this configuration, up to or over about 99% of the ethane content from the feed gas can be recovered.

Figure 7:
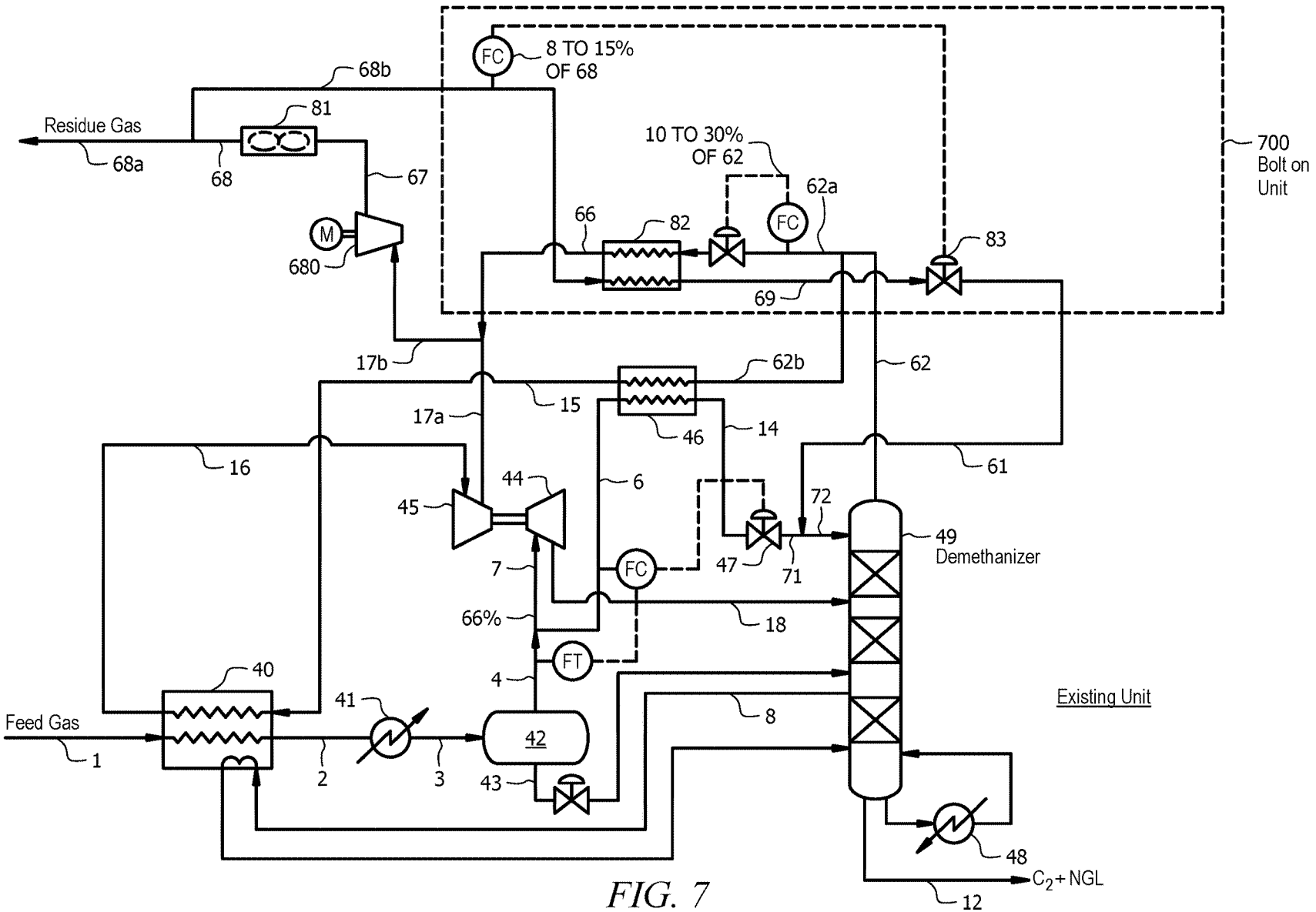
FIG. 7 illustrates a bolt-on unit utilizing an existing residue gas compressor requiring no changes to equipment in the existing facility for use with an NGL plant.

FIG. 7 illustrates an alternate configuration of the bolt-on unit 600 described above in FIG. 6 that can reduce the cost of the bolt-on unit 700 by removing the absorber 84 and bottom pump 85. The bolt-on unit 700 may be used with the systems as described in the preceding Figures, where only the new parts of the system are described below, and the description of the previously described elements is hereby repeated. Where about 95% to 97% ethane recovery is the recovery target, the absorber and bottom pump may not be required, which would simplify the process, and would reduce the capital cost. Therefore, the bolt-on unit 700 may comprise the reflux exchanger 82, as shown in FIG. 7. In this configuration, the reflux stream 69 (i.e. the residue gas stream 69) from reflux exchanger 82 can be letdown in pressure, mixed with the reflux stream 71, and fed to the demethanizer 49 as a combined reflux stream 72. The split ratio of the recycle stream 68*b* to the total stream 68 (as described with respect to FIG. 6) can be maintained at between about 8% to 15%, and the split ratio of the demethanizer overhead stream 62*a* to the total absorber overhead vapor stream 62 (as described with respect to FIG. 6) can be maintained at between about 10% to 30%. With the arrangement shown in FIG. 7, no change is required to the demethanizer 49.

Figure 8:
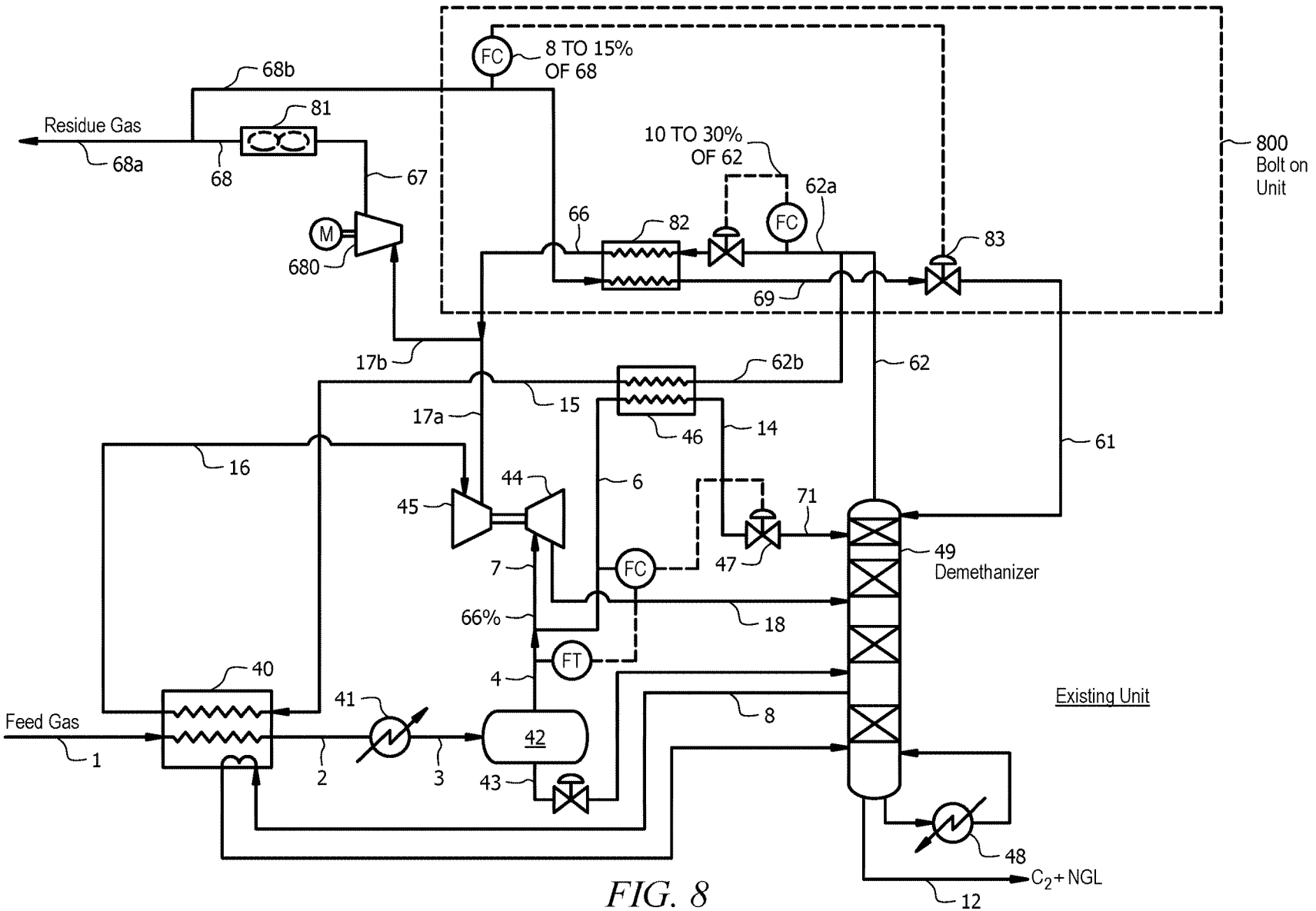
FIG. 8 illustrates a bolt-on unit requiring minor modifications to the existing demethanizer for use with an NGL plant.

FIG. 8 illustrates an alternate configuration that can reduce the cost of the bolt-on unit (relative to the bolt-on unit 600 described in FIG. 6) by removing the absorber 84 and bottom pump 85 and by integrating the absorber system into the demethanizer 49. The bolt-on unit 800 may be used with the systems as described in the preceding Figures, where only the new parts of the system are described below, and the description of the previously described elements is hereby repeated. This alternative can recover up to about 99% ethane. The existing demethanizer 49 can be modified for installation of a reflux nozzle for the recycle gas lean reflux stream 61. In this option, the existing demethanizer 49 can be revamped to add rectification trays, as shown in FIG. 8.

In the configuration of FIG. 8, the reflux stream 69 (i.e. residue gas stream 69) from reflux exchanger 82 can be letdown in pressure and fed to the top of the demethanizer 49 while the feed gas reflux stream 71 is fed to the lower section of the demethanizer 49 at about the fourth tray below the top tray. The split ratio of the recycle stream 68*b* to the total stream 68 (as described with respect to FIG. 6) can be maintained at about 8% to 15%, and the split ratio of the demethanizer overhead stream 62*a* to the total overhead vapor stream 62 (as described with respect to FIG. 6) can be maintained at about 10% to 30%.

Thus, specific embodiments and applications of retrofit of NGL plant configurations for up to about 96% to 99% ethane recovery have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, utilized, or combined with other elements, components, or steps that are not expressly referenced.

Having described various devices and methods herein, exemplary embodiments or aspects can include, but are not limited to:

In a first embodiment, a natural gas liquid plant bolt-on unit may comprise an absorber configured to condense the ethane content from an overhead gas stream from a demethanizer using a cold lean residue gas to produce a liquid portion and a vapor portion, wherein the liquid portion is configured to provide a reflux to the demethanizer, and the vapor portion is configured to provide cooling of a reflux exchanger and a subcooler; and a flow control valve, wherein the flow control valve is configured to pass about 10% to about 30% of the vapor portion to provide cooling to the absorber in the reflux condenser, and about 70% to 90% of the vapor portion to reflux cooling and reflux of the demethanizer in the subcooler.

A second embodiment can include the bolt-on unit of the first embodiment, wherein the overhead gas from the existing demethanizer is at a pressure between about 250 psig to about 350 psig.

A third embodiment can include the bolt-on unit of the first or second embodiments, wherein the absorber and the reflux exchanger are fluidly coupled to a residue gas compressor and the demethanizer for 99% ethane recovery.

A fourth embodiment can include the bolt-on unit of any of the first to third embodiments, wherein a reduction device of the reflux liquid comprises a Joule-Thompson valve.

A fifth embodiment can include the bolt-on unit of any of the first to fourth embodiments, wherein, when ethane recovery of about 95% to 97% is the target, the refluxes are combined and fed to the demethanizer, eliminating the need for the absorber.

A sixth embodiment can include the bolt-on unit of any of the first to fifth embodiments, wherein, when ethane recovery of 97% to 99% is required, the demethanizer is modified with additional rectification trays, without the need for the absorber.

In a seventh embodiment a method may comprise passing an overhead vapor stream from a demethanizer to an absorber; contacting the overhead vapor stream with a cold lean residue gas to produce a liquid portion and a vapor portion within the absorber; passing the liquid portion back to the demethanizer as reflux; and passing the vapor portion to a subcooler, wherein the subcooler cools at least a first portion of the vapor portion to produce the cold lean residue gas.

An eighth embodiment can include the method of the seventh embodiment, further comprising: passing at least a second portion of the vapor portion to a second heat exchanger; and cooling at least a portion of a feed stream to the demethanizer with the second portion of the vapor portion in the second heat exchanger.

A ninth embodiment can include the method of the seventh or eighth embodiments, wherein passing the vapor portion to the subcooler comprises: passing the vapor portion to a first heat exchanger; cooling a compressed cooled residue gas using at least the first portion of the vapor portion in the first heat exchanger; compressing the first portion of the vapor portion downstream of the first heat exchanger to produce a compressed vapor portion; cooling the compressed vapor portion to produce the compressed cooled residue gas that passes to the first heat exchanger; and passing the compressed cooled residue gas to a pressure reduction device to produce the cold lean residue gas.

A tenth embodiment can include the method of the ninth embodiment, wherein the pressure reduction device comprises a hydraulic turbine or a Joule-Thompson valve.

An eleventh embodiment can include the method of any of the seventh to tenth embodiments, wherein the first portion of the vapor portion comprises between about 10% and about 30% of the vapor portion.

A twelfth embodiment can include the method of any of the ninth to eleventh embodiments, further comprising: separating a feed stream into a liquid portion and a feed gas vapor portion; cooling at least a first portion of the feed gas vapor portion in the subcooler using at least the first portion of the vapor portion; expanding at least a second portion of the feed gas vapor portion; and passing the expanded second portion of the feed gas vapor portion to the demethanizer.

In a thirteenth embodiment, a method may comprise passing an overhead vapor stream from a demethanizer to a first heat exchanger; cooling a compressed cooled residue gas using at least a first portion of the overhead vapor stream from the demethanizer in the first heat exchanger; compressing the first portion of the overhead vapor stream downstream of the first heat exchanger to produce a compressed vapor portion; cooling the compressed vapor portion to produce the compressed cooled residue gas that passes to the first heat exchanger; passing the compressed cooled residue gas to a pressure reduction device to produce a cold lean residue gas; and passing the cold lean residue gas to the demethanizer as reflux.

A fourteenth embodiment can include the method of the thirteenth embodiment, further comprising passing at least a second portion of the vapor portion to a second heat exchanger; and cooling at least a portion of a feed stream to the demethanizer with the second portion of the vapor portion in the second heat exchanger.

A fifteenth embodiment can include the method of the thirteenth or fourteenth embodiments, wherein the pressure reduction device comprises a hydraulic turbine or a Joule-Thompson valve.

A sixteenth embodiment can include the method of any of the thirteenth to fifteen embodiments, wherein the first portion of the overhead vapor stream comprises between about 10% and about 30% of the vapor portion.

In a seventeenth embodiment, a natural gas liquid plant bolt-on unit may comprise an absorber that condenses the ethane content from the overhead gas from a demethanizer using a cold lean residue gas to produce a liquid portion and a vapor portion, wherein the liquid portion is configured to provide to reflux to the demethanizer, and the vapor portion is configured to provide cooling of the reflux condenser and a subcooler; and a flow control valve, wherein the flow control valve is configured to pass about 10% to about 30% of the vapor portion to provide cooling to the recycle stream, and about 70% to 90% of the vapor portion to reflux cooling and reflux of the demethanizer.

In an eighteenth embodiment, a method may comprise passing an overhead vapor stream from a demethanizer to an absorber; producing a liquid portion and a vapor portion within the absorber; passing the liquid portion back to the demethanizer as reflux; and passing at least a first portion of the vapor portion to a subcooler, separating a feed stream into a liquid portion and a feed gas vapor portion; cooling at least a first portion of the feed gas vapor portion in the subcooler using at least the first portion of the vapor portion; expanding at least a second portion of the feed gas vapor portion; and passing the expanded second portion of the feed gas vapor portion to the demethanizer.

In a nineteenth embodiment, a method may comprise splitting an overhead vapor stream from a demethanizer into at least a first overhead portion and a second overhead portion; passing the first overhead portion to a first heat exchanger; cooling a compressed residue gas using at least the first overhead portion of the overhead vapor stream from the demethanizer in the first heat exchanger; compressing the first overhead portion downstream of the first heat exchanger to produce a compressed vapor portion; cooling the compressed vapor portion to produce at least a portion of the compressed cooled residue gas that passes to the first heat exchanger; passing the compressed cooled residue gas to a pressure reduction device to produce a cold lean residue gas; and passing the cold lean residue gas to the demethanizer as reflux.

A twentieth embodiment can include the method of the nineteenth embodiment, further comprising passing the second overhead portion to a second heat exchanger; and cooling at least a portion of a feed stream to the demethanizer with the second overhead portion in the second heat exchanger.

A twenty-first embodiment can include the method of the nineteenth or twentieth embodiments, wherein the pressure reduction device comprises a hydraulic turbine or a Joule-Thompson valve.

A twenty-second embodiment can include the method of any of the nineteenth or twenty-first embodiments, wherein the first portion of the overhead vapor stream comprises between about 10% and about 30% of the overhead vapor stream.

In a twenty-third embodiment, a natural gas liquid plant bolt-on unit may comprise a heat exchanger configured to receive a first portion of an overhead gas stream from a demethanizer, cool a compressed residue gas using at least the first portion of the overhead gas stream from the demethanizer in the heat exchanger, and pass the compressed cooled residue gas to the demethanizer as reflux; and a flow control valve, wherein the flow control valve is configured to pass about 10% to about 30% of the overhead gas stream to the heat exchanger.

A twenty-fourth embodiment can include the bolt-on unit of the twenty-third embodiment, wherein the flow control valve is further configured to pass about 70% to 90% of the overhead gas stream a subcooler to cool a first portion of an inlet gas stream.

A twenty-fifth embodiment can include the bolt-on unit of the twenty-third or twenty-fourth embodiments, further comprising a pressure reduction device configured to receive compressed cooled residue gas from the heat exchanger and reduce the pressure of the compressed cooled residue gas prior to passing the compressed cooled residue gas to the demethanizer as reflux.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above, but is defined by the claims which follow that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as "comprises," "includes," and "having" should be understood to provide support for narrower terms such as "consisting of," "consisting essentially of," and "comprised substantially of." Use of the terms "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A natural gas liquid plant bolt-on unit, comprising:

an absorber configured to condense an ethane content from an overhead gas stream from a demethanizer using a cold lean residue gas to produce a liquid portion and a vapor portion, wherein the demethanizer is configured to receive the liquid portion as a first reflux;

a reflux exchanger configured to receive at least a portion of the vapor portion and use the portion of the vapor portion to provide cooling within the reflux exchanger; and a flow control valve configured to direct between about 70% to 90% of the vapor portion to a subcool exchanger to provide cooling to a portion of a feed stream that is directed to the demethanizer and configured to direct about 10% to about 30% of the vapor portion to the reflux exchanger to provide the cooling within the reflux exchanger to cool a residue gas stream that is directed to the absorber.

2. The natural gas liquid plant bolt-on unit of claim 1, wherein the overhead gas is at a pressure between about 250 psig to about 350 psig.

3. The natural gas liquid plant bolt-on unit of claim 1, wherein the absorber and the reflux exchanger are fluidly coupled to a residue gas compressor and the demethanizer, and wherein the natural gas liquid plant is configured to provide at least a 99% ethane recovery.

4. The natural gas liquid plant bolt-on unit of claim 1, further comprising a reduction device comprising a Joule-Thompson valve, wherein the reduction device is configured to receive the residue gas stream and expand the residue gas stream to form a reflux stream that is directed to the absorber.

5. The natural gas liquid plant bolt-on unit of claim 1, wherein the liquid portion is configured to be combined with the portion of the feed stream after cooling in the subcool exchanger and before introduction into the demethanizer.

6. The natural gas liquid plant bolt-on unit of claim 1, further comprising a compressor configured to receive the about 10% to about 30% of the vapor portion from the reflux exchanger and to compress the about 10% to about 30% of the vapor portion.

7. The natural gas liquid plant bolt-on unit of claim 6, further comprising an air cooler configured to receive the about 10% to about 30% of the vapor portion from the compressor, cool the about 10% to about 30% of the vapor portion, and direct the about 10% to about 30% of the vapor portion to the reflux exchanger as the residue gas stream.

8. The natural gas liquid plant bolt-on unit of claim 7, further comprising a reduction device that is configured to receive the residue gas stream from the reflux exchanger and expand the residue gas stream to form a reflux stream that is directed to the absorber.

* * * * *